US008499770B2

(12) United States Patent
Smith

(10) Patent No.: US 8,499,770 B2
(45) Date of Patent: Aug. 6, 2013

(54) DEVICE FOR THE APPLICATION OF A HAIR TREATMENT COMPOSITION TO A HAIR BUNDLE

(75) Inventor: Paul James Smith, Twickenham (GB)

(73) Assignee: The Procter & Gamble Company, Cincinnati, OH (US)

( * ) Notice: Subject to any disclaimer, the term of this patent is extended or adjusted under 35 U.S.C. 154(b) by 1056 days.

(21) Appl. No.: 12/135,334

(22) Filed: Jun. 9, 2008

(65) Prior Publication Data

US 2008/0308119 A1 Dec. 18, 2008

(30) Foreign Application Priority Data

Jun. 15, 2007 (EP) ..... 07110391
Jun. 15, 2007 (EP) ..... 07110395
Dec. 14, 2007 (EP) ..... 07123228

(51) Int. Cl.
*A45D 19/18* (2006.01)
*A61K 8/18* (2006.01)

(52) U.S. Cl.
USPC ..... 132/270; 132/208

(58) Field of Classification Search
USPC ..... 132/208, 270, 108–112
See application file for complete search history.

(56) References Cited

U.S. PATENT DOCUMENTS 2,272,409 A 2/1942 Johnson
2,310,295 A 2/1943 Keele
2,776,667 A 1/1957 Fitzgerald
2,962,031 A 11/1960 Bumgarner
3,030,968 A * 4/1962 Oberstar et al. ..... 132/212
3,662,767 A 5/1972 Murtha
3,702,508 A 11/1972 Netter
3,921,647 A 11/1975 Fisher
4,020,854 A 5/1977 Caruso
4,108,184 A 8/1978 Morganroth
4,398,549 A 8/1983 Thomas
4,503,870 A 3/1985 Peterson
4,796,812 A 1/1989 Grollier
4,942,893 A 7/1990 Trottier
5,042,514 A 8/1991 Bastien
5,060,679 A 10/1991 Christopher et al.
5,279,313 A 1/1994 Clausen
5,535,764 A 7/1996 Abramson
5,554,197 A 9/1996 Assini (Continued)

FOREIGN PATENT DOCUMENTS

DE 662702 C1 7/1938
DE 197639177 U1 4/1977

(Continued)

*Primary Examiner* — Rachel Steitz
(74) *Attorney, Agent, or Firm* — Carl J. Roof; James T. Fondriest

(57) ABSTRACT

The device (1) for creating hair bundle effects to a hair bundle (11) described herein comprises a first portion (10) movably joined to a second portion (20) by means of a connection (30). The second portion (20) is associated with a system (70) for bending a hair bundle (11) within a cavity (12) provided in the first portion (10). The system (70) for bending the hair bundle (11) consists of at least a first fin (71) and of a second fin (72). The free distal edge (712) of the first fin (71) points toward the free distal edge (722) of the second fin (72). The device (1) preferably comprises a first metering layer (81) and more preferably also a second metering layer (82) to achieve evenness during the application of a hair treatment composition (15) to hair.

20 Claims, 30 Drawing Sheets

U.S. PATENT DOCUMENTS

| | | | | |
|---|---|---|---|---|
| 5,771,906 | A | 6/1998 | De Benedictis | |
| 5,823,204 | A | 10/1998 | Todd | |
| 5,848,730 | A | 12/1998 | Kawase | |
| 5,971,645 | A | 10/1999 | Fukushima | |
| 6,062,231 | A | 5/2000 | De LaForcade | |
| 6,148,829 | A | 11/2000 | De Benedictis | |
| 6,250,312 | B1 | 6/2001 | Dasilva | |
| 6,427,701 | B1 | 8/2002 | Roth | |
| 6,440,175 | B1 | 8/2002 | Stanley | |
| 6,626,599 | B2 | 9/2003 | Delaforcade | |
| 6,748,957 | B1 | 6/2004 | Giordano | |
| 7,025,069 | B2 | 4/2006 | Thiebaut | |
| 7,156,885 | B2 * | 1/2007 | Kennedy et al. | 8/405 |
| 7,198,049 | B2 | 4/2007 | Elmer | |
| 7,357,137 | B2 | 4/2008 | Husband | |
| 7,425,220 | B2 | 9/2008 | Barrass | |
| 7,475,688 | B2 | 1/2009 | Colacioppo | |
| 7,543,591 | B1 | 6/2009 | Munsil | |
| 7,640,939 | B2 | 1/2010 | Ploix | |
| 2002/0114657 | A1 | 8/2002 | Gueret | |
| 2002/0142027 | A1 | 10/2002 | Gueret | |
| 2002/0197228 | A1 | 12/2002 | Lasala | |
| 2003/0007825 | A1 | 1/2003 | De LaForcade | |
| 2004/0016064 | A1 | 1/2004 | Vena | |
| 2004/0031502 | A1 | 2/2004 | Winckels | |
| 2004/0089316 | A1 | 5/2004 | Hamilton | |
| 2004/0182408 | A1 | 9/2004 | De LaForcade | |
| 2005/0079192 | A1 | 4/2005 | Simon | |
| 2005/0207153 | A1 | 9/2005 | Leleve | |
| 2005/0211599 | A1 | 9/2005 | De LaMettrie | |
| 2006/0042643 | A1 | 3/2006 | Delan | |
| 2006/0064824 | A1 | 3/2006 | Godfrey | |
| 2006/0090771 | A1 | 5/2006 | Ramet | |
| 2006/0144415 | A1 | 7/2006 | Magee | |
| 2006/0207036 | A1 | 9/2006 | Kennedy | |
| 2007/0144550 | A1 | 6/2007 | Roher | |
| 2007/0215170 | A1 | 9/2007 | Kennedy | |
| 2007/0227620 | A1 | 10/2007 | Kunii | |
| 2008/0000492 | A1 | 1/2008 | Mills | |
| 2008/0083418 | A1 | 4/2008 | Glenn | |
| 2008/0083419 | A1 | 4/2008 | Glenn | |
| 2008/0083420 | A1 | 4/2008 | Glenn | |
| 2008/0087292 | A1 | 4/2008 | Abergel | |
| 2008/0087293 | A1 | 4/2008 | Glenn | |
| 2008/0087294 | A1 | 4/2008 | Glenn | |
| 2008/0110929 | A1 | 5/2008 | Stanley | |
| 2008/0156817 | A1 | 7/2008 | Roseblade | |
| 2008/0196734 | A1 | 8/2008 | Husband | |
| 2008/0223386 | A1 | 9/2008 | Albisetti | |
| 2008/0223391 | A1 | 9/2008 | Baker | |
| 2008/0223393 | A1 | 9/2008 | Boyle | |
| 2008/0257370 | A1 | 10/2008 | Perry | |
| 2008/0308119 | A1 | 12/2008 | Smith | |
| 2009/0050171 | A1 | 2/2009 | Barrass | |
| 2009/0071496 | A1 | 3/2009 | Glenn | |
| 2009/0084393 | A1 | 4/2009 | Baker | |
| 2009/0084394 | A1 | 4/2009 | Baker | |
| 2009/0084395 | A1 | 4/2009 | Glenn | |
| 2009/0095314 | A1 | 4/2009 | Lund | |
| 2009/0101159 | A1 | 4/2009 | Bonnafous | |
| 2009/0152281 | A1 | 6/2009 | Bowes | |
| 2009/0223531 | A1 | 9/2009 | Lund | |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 10290712 | A | 11/1998 |
| JP | 11-178630 | | 7/1999 |
| JP | 11-178639 | A | 7/1999 |
| JP | 2001-211925 | A | 8/2001 |
| JP | 2001523500 | A | 11/2001 |
| JP | 2002-034636 | A | 2/2002 |
| JP | 2003-199623 | A | 7/2003 |
| JP | 2003-310337 | A | 11/2003 |
| JP | 2004338725 | A | 12/2004 |
| JP | 2006043434 | A | 2/2006 |
| JP | 2006082852 | A | 3/2006 |
| JP | 3129205 | U | 2/2007 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

* cited by examiner

DEVICE FOR THE APPLICATION OF A HAIR TREATMENT COMPOSITION TO A HAIR BUNDLE

FIELD OF THE INVENTION

The present invention relates to a device which allows for a precise, clean and non-messy application of a hair treatment composition to a bundle of keratinous fibers, preferably hair. The device according to the invention is especially intended for hair treatment compositions for creating hair bundle effects.

BACKGROUND OF THE INVENTION

The application of hair treatment compositions to distinct hair bundles is a popular and conventional way of changing hair appearance. Hair treatment compositions for creating hair bundle effects include highlighting compositions, dyeing compositions, perming compositions, styling compositions or mixtures thereof.

Hair bundle effects such as those provided by highlighting compositions and dyeing compositions must be precisely applied where desired. The instructions provided by manufacturers of consumer products for creating hair bundle effects are generally confined to how to mix and safely apply the hair treatment composition to the hair. However, at home consumers are faced with the challenge of applying the hair treatment composition in a tidy and clean manner and reproducing hair bundle effects similar to those obtained at professional salons.

For example, if an excessive amount of hair treatment composition is applied to the hair bundle, that hair treatment composition may transfer to the remaining hair and may alter the overall end result. In addition, hair treatment compositions such as highlighting and dyeing compositions comprise strong oxidants to bleach the melanin pigments. In view of their reactive chemical nature, most applications of highlighting and dyeing compositions, if unexpectedly delivered in excess to the root-line of the hair bundle may also transfer to the scalp. This can lead in some cases to unnecessary scalp irritation. Finally, uneven application of a hair treatment composition along the length of the hair bundles may create a visually unacceptable end result.

The cap and hook system for creating highlighting is well known in the art. The cap (2) is provided with holes (4) as shown in FIG. 1. The cap (2) is positioned tightly over the hair and the scalp and a hair bundle (11) is then selected by pulling out the hair bundle (11) through the hole (4) with a hook (3). This step is repeated for a plurality of hair bundles. The selected hair bundles are then treated with a highlighting composition. The cap and hook system suffers from several drawbacks. First, the process of pulling the hair bundles through the holes in the cap is painful. Second, the choices as to the location of the hair bundle to be treated are limited to where the holes are in the cap. Thirdly, the process of pulling the hair bundles through the holes can lead to unexpected end results, because the hair bundle pulled through the hole does not necessarily come from the scalp directly below the hole.

Some alternatives to the cap and hook system have been proposed in U.S. Pat. No. 6,062,231, US2003/0024544 and U.S. Pat. No. 3,030,968. Nevertheless, none of these disclosures provide for a device that allows for the self-application of a hair treatment composition in a tidy, clean and non-messy fashion and for creating similar hair bundle effects as those obtained at professional salons.

It is generally recognized that the self-application of hair treatment compositions for creating hair bundle effects are difficult per se, in particular those for creating highlighting. To achieve the expected end results, a device capable of facilitating the self-application of hair treatment compositions needs to be conceived to address several technical challenges.

The device should facilitate consumers in the application of hair treatment compositions for creating a quality of hair bundle effects comparable to those created by professional stylists. The device should be designed to apply hair treatment compositions typically formulated as gel, cream or paste, avoiding displacement and dripping out of the hair treatment composition from the device during use to prevent messiness. The device should be easy to use; it should be doubtless cheap and easy to produce and it should not require any special experience and training in matters such as how much and where to load the hair treatment composition. Ideally, the consumer should be able to load and use the applicator by simply following a few instructions provided by the manufacturer.

Thus, what still remains to be solved in the art is a device capable of overcoming the technical problem defined above.

It has now been found that the device (as defined herein after) can significantly improve the application of hair treatment compositions for providing hair bundle effects.

SUMMARY OF THE INVENTION

The present invention provides a solution to the above described technical problem in a first aspect by means of a device (1) for creating hair bundle effects to a hair bundle (11), the device (1) comprising a. a first portion (10) and b. a second portion (20);

wherein the first portion (10) comprises a cavity (12) for comprising a hair treatment composition (15); wherein a system (70) for bending the hair bundle (11) within the cavity (12) of the first portion (10) is associated to the second portion (20); wherein the system (70) comprises at least a first fin (71) and a second fin (72); wherein each fin (71; 72) has a free distal edge (712; 722); wherein the first free distal edge (712) of the first fin (71) points towards the second free distal edge (722) of the second fin (72); wherein the first portion (10) is movably joined to the second portion (20) by a connection (30), thereby the second portion (20) is brought from a remote relationship to a juxtaposed relationship to the first portion (10); and wherein in that juxtaposed relationship at least a portion of the first fin (71) and/or of the second fin (72) projects within the cavity (12) of the first portion (10).

In a second aspect, the invention herein disclosed solves the above technical problem by means of kit (60) for creating hair bundle effects comprising at least one device (1) as described herein and a hair treatment composition (15). The present invention also relates to a method for creating hair bundle effects comprising the steps of:

a. selecting a hair bundle (11);

b. optionally, marking and separating the selected hair bundle (11) by applying one or more markings tools (300; 300');

c. placing at least a portion of the selected hair bundle (11) between the first portion (10) and the second portion (20) of the device (1) as described herein; and d. bringing the first portion (10) into a juxtaposed relationship to the second portion (20).

DETAILED DESCRIPTION OF THE INVENTION

Definitions

For the purpose of this invention, the term "hair" refers to both living hair, i.e. on a living body and to non-living hair, i.e. in a wig, hair piece or other aggregation of non-living keratinous fibres. Mammalian, preferably human hair is intended.

By "hair bundle" is meant at least two individual hair fibres.

By "hair bundle effect" is meant an effect created on a plurality of independent hair bundles rather than on a full head of hair. The effect may be a lighter or lower tone of the hair bundles than the remaining hair, a different colour or different styles such as curling or frizzing.

For the purpose of this invention, the term "point towards" is used as a synonym for tend towards; bend towards; point to; point at; and verge. The term "point towards" is used to indicate the direction of the feature to which it refers.

For the purpose of this invention, the term "plate" is used herein as a synonym for "cap", "top", "lid" and "cover".

For the purpose of this invention, the term "cavity" is used herein as a synonym for depression, niche, hole, well, pocket and crater.

For the purpose of this invention, the term "extend upon" is used to indicate where the feature is located and not the act of locating it.

1. Device

The specific combination of features within the device (1) according to the invention provides a solution to the technical problem described above. The device (1) is preferably of ergonomic size, more preferably it should fit easily on either hand.

Figure 1:
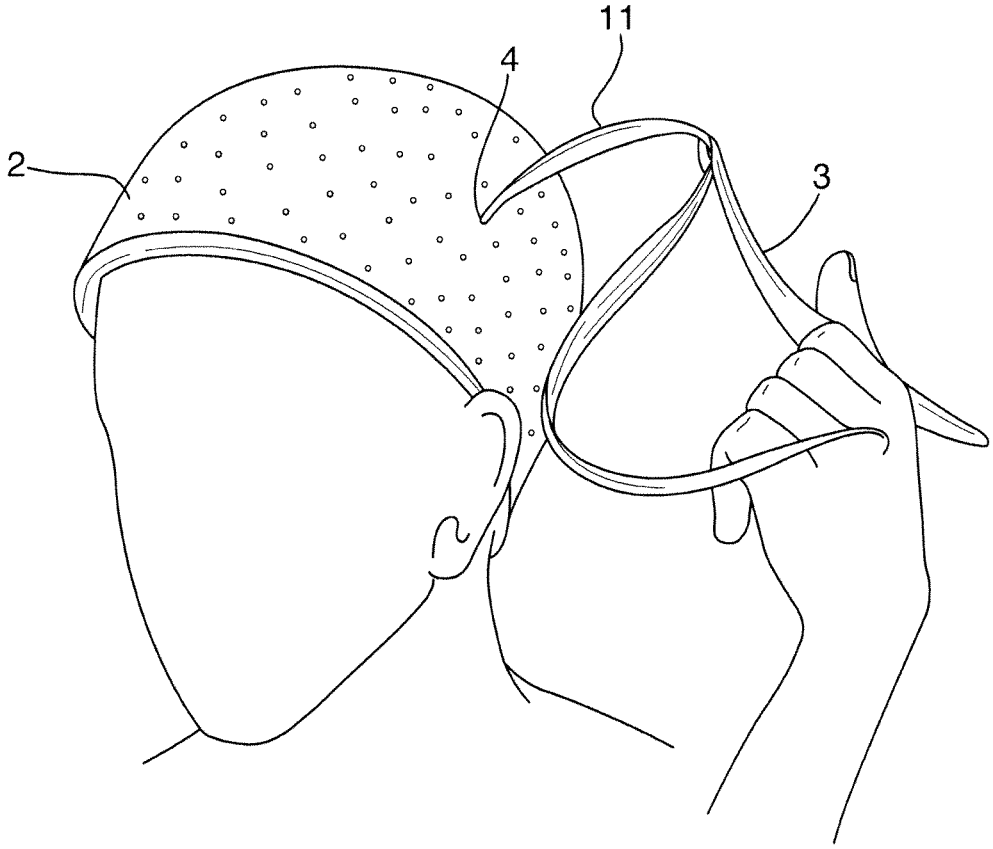
Fig.1. (Prior Art)
FIG. 1 illustrates an embodiment of the prior art for highlighting hair using the cap and hook system.
Figure 2:
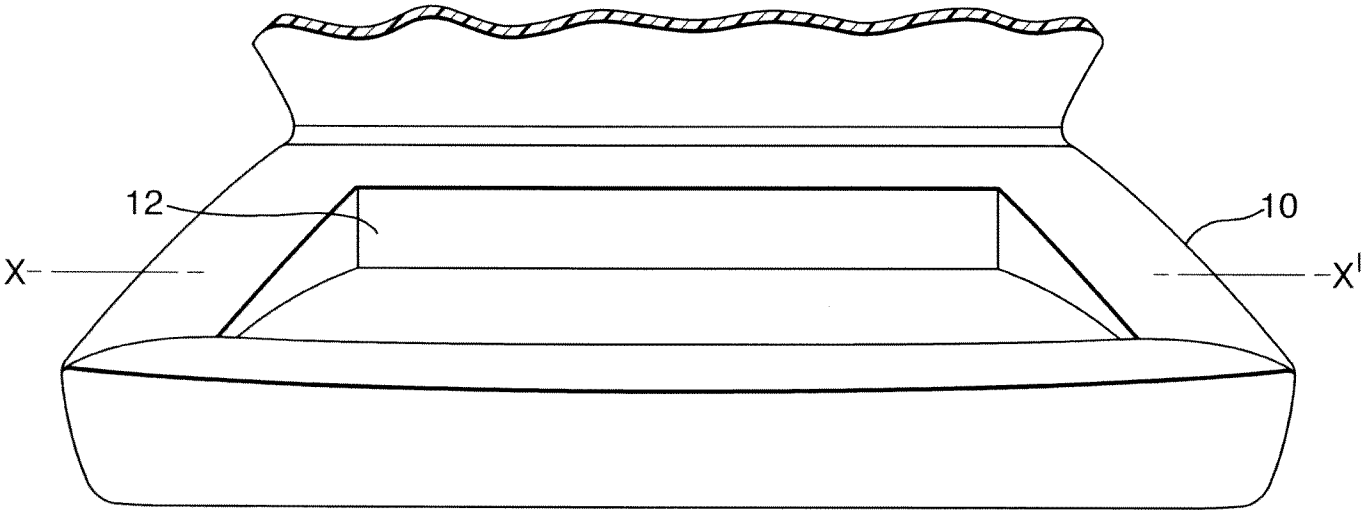
FIG. 2 is a perspective view of a part of an embodiment of the device (1); the part shown is the first portion (10).
Figure 3:
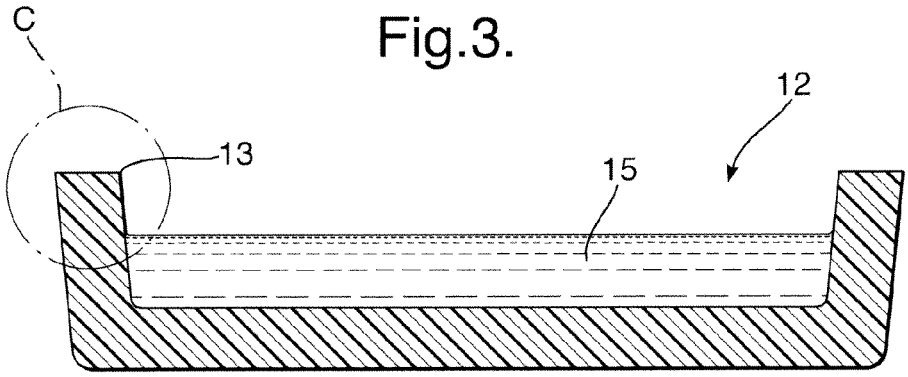
FIG. 3 is a cross-sectional view along axis X-X' of the embodiment shown in FIG. 2.
Figure 4:
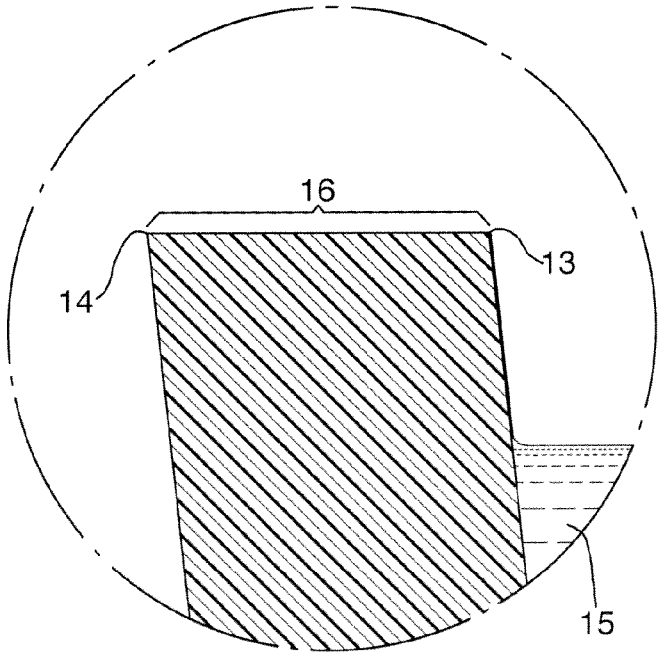
FIG. 4 is a magnification of a part of the embodiment delimited by the circle C shown in FIG. 3.

The first portion (10) of the device according to the invention comprises a cavity (12) as shown in FIG. 2. The cavity (12) is for comprising a hair treatment composition (15). The cavity (12) may be substantially circular, oblong, square or rectangular. Irrespectively of its shape, it is necessary that the cavity (12) accommodates enough hair treatment composition (15) to provide at least one hair bundle effect on a single hair bundle. Preferably the cavity (12) of the device (1) contains a volume of hair treatment composition (15) of from about 0.25 $cm^3$ to about 30.00 $cm^3$, more preferably from about 0.50 $cm^3$ to about 15.00 $cm^3$, even more preferably from about 1.00 $cm^3$ to about 10.00 $cm^3$. It will be easily apparent that the first portion (10) may as well be called a case, a container, a housing, a shell, a chamber and a reservoir. The cavity (12) is delimited by a perimeter (13) as shown in FIG. 4. The profile of the perimeter (13) may be selected from the group consisting of a curved profile, a sharp profile, a crenellated profile, a waived profile and combinations thereof.

The first portion (10) further comprises an outer edge (14) as shown in FIG. 4. Similarly as described above for the perimeter (13), the profile of the outer edge (14) may be selected from the group consisting of a curved profile, a sharp profile, a crenellated profile, a waived profile and combinations thereof. A control zone (16) extends between the perimeter (13) of the cavity (12) and the outer edge (14) of the first portion (10). Without wishing to be bound by theory it is believed that the presence of a control zone (16) within the device (1) according to the invention limits oozing and dripping of the hair treatment composition (15) outside of the device (1). When the device (1) is used, the hair treatment composition (15) may be displaced from the cavity (12). The control zone (16) prevents dripping of the displaced hair treatment composition (15) from the device (1) by contributing with an area where the composition may to move to. The control zone (16) preferably has a width of from about 1 mm to about 20 mm, more preferably from about 2 mm to about 15 mm, even more preferably from about 2 mm to about 8 mm.

Figure 5:
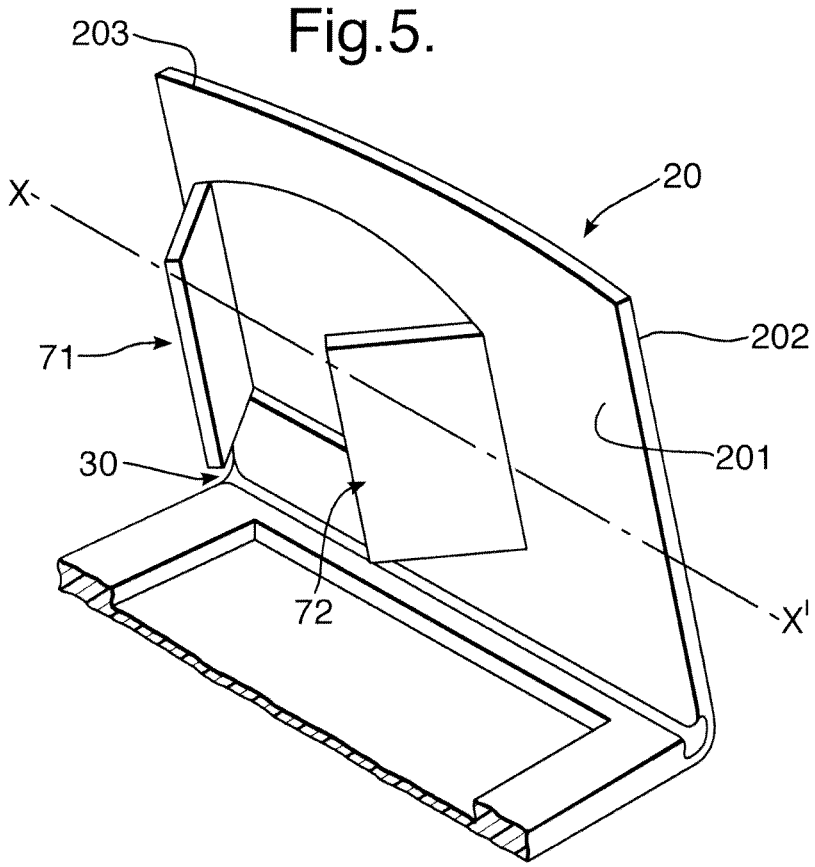
FIG. 5 is a perspective view of a part of an embodiment of the device (1). The parts shown are the second portion (20) and the connection (30).
Figure 6:
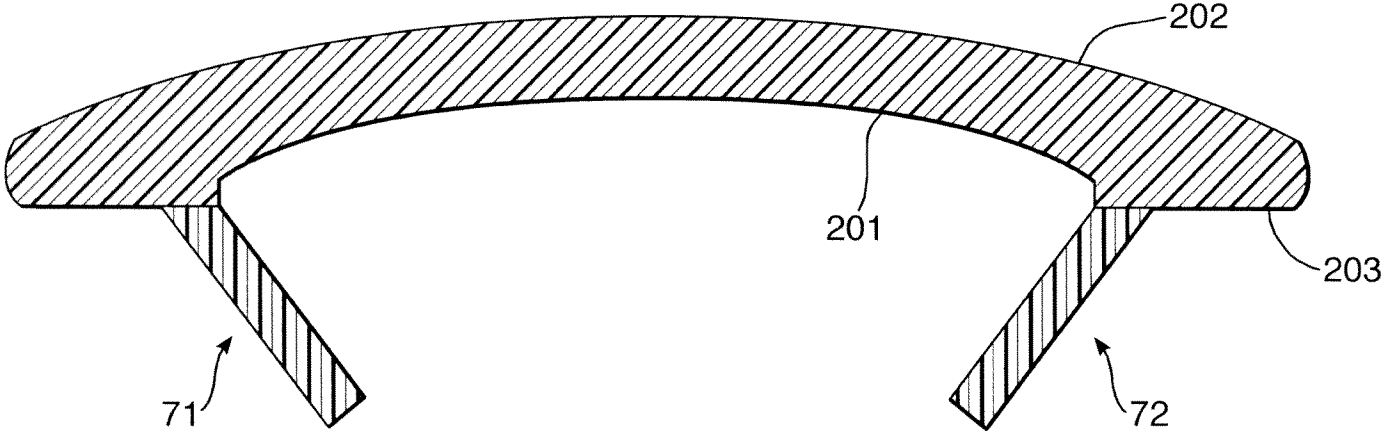
FIG. 6 is a cross-sectional view along axis X-X' of the embodiment shown in FIG. 5.
Figure 7:
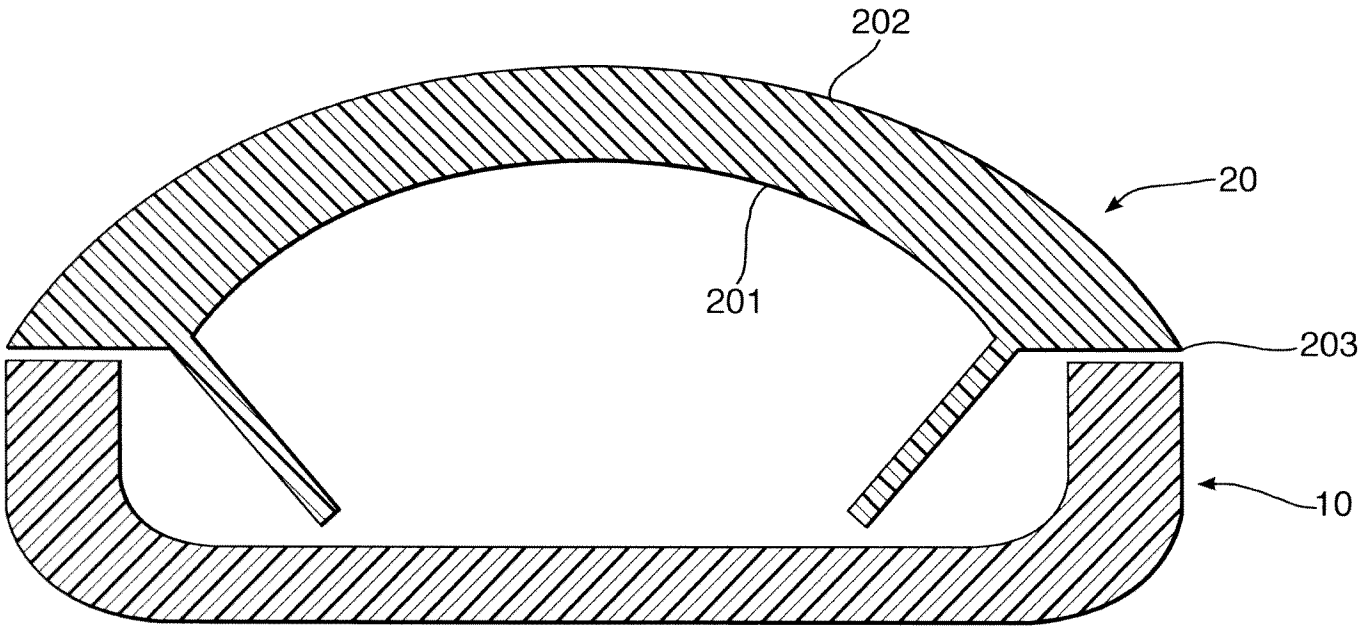
FIG. 7 is a cross-sectional view of an embodiment of the device (1).
Figure 8:
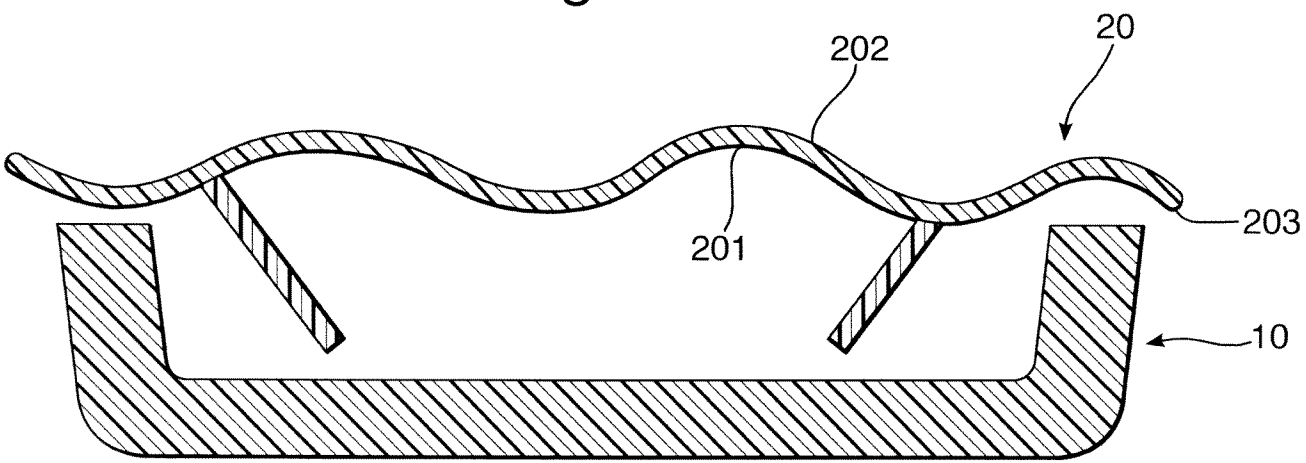
FIG. 8 is a cross-sectional view of another embodiment of the device (1).
Figure 9:
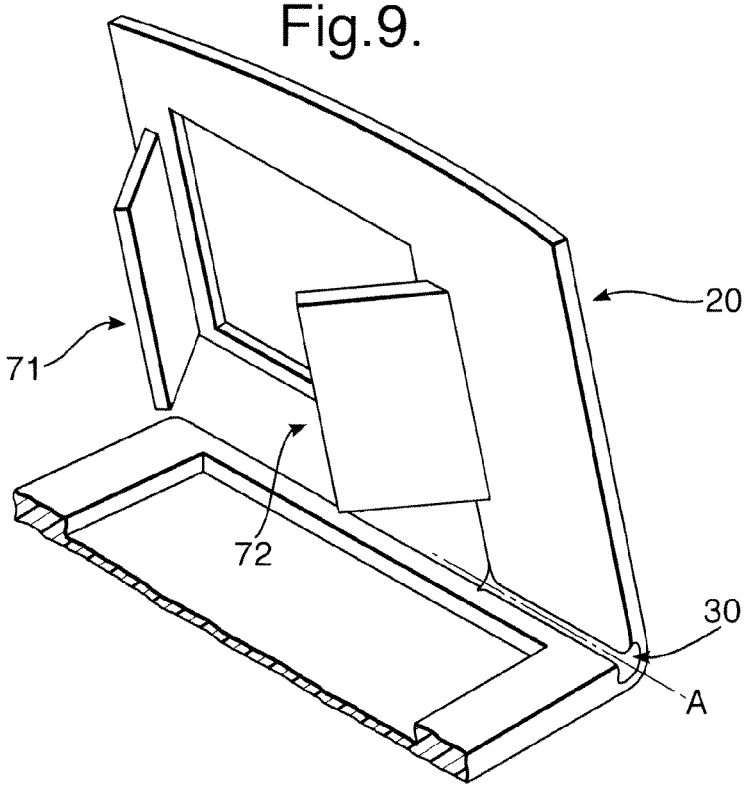
FIG. 9 is a perspective view of a part of an embodiment of the device (1) to show the form and shape of the second portion (20).
Figure 10:
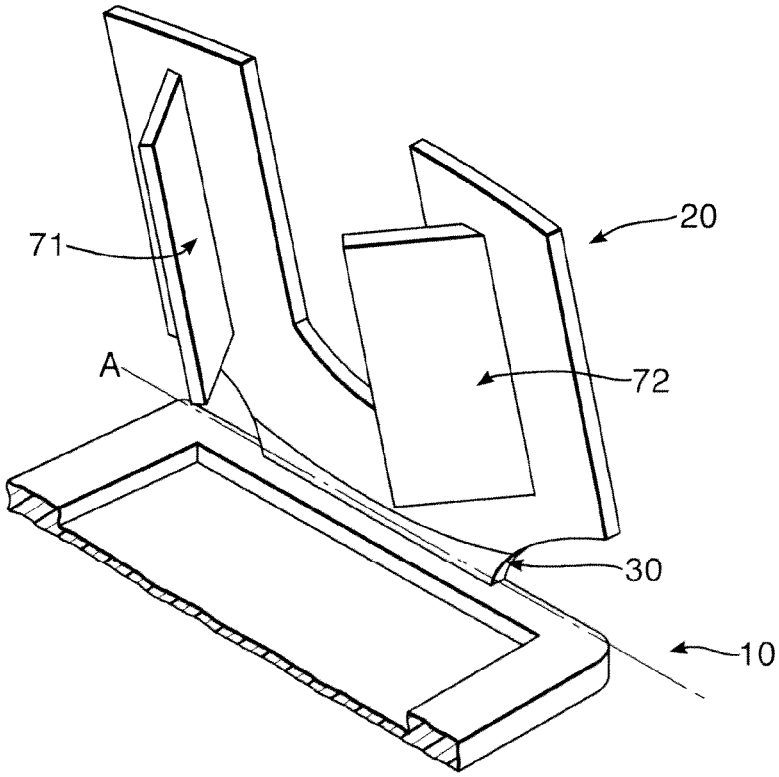
FIG. 10 is a perspective view of a part of an embodiment of the device (1). This embodiment shows the shape and the form of the second portion (20).

The device (1) further comprises a second portion (20). The second portion (20) may have various forms and shapes. Preferably the second portion (20) is a plate. The plate may have constant or variable thickness across its length and width. The plate comprises an internal surface (201), an external surface (202) and a contour (203) as shown in FIGS. 5 and 6. The plate may be selected from the group consisting of a substantially flat plate, a convex plate, a concave plate and combinations thereof as shown in FIGS. 7 and 8. Alternatively, the second portion (20) may comprise multiple pieces mechanically or chemically connected to form for example annular, U-shaped, V-shape or C-shaped portions. Some examples thereof are shown in FIGS. 9 and 10.

The first portion (10) and the second portion (20) may be manufactured from materials including; polyolefins, acrylonitrile butadiene styrene, where appropriate; flexible pliable substrates such a paper boards, and polycarbonate and combinations therefore. Useful methods of manufacture may include injection moulding, co-injection moulding and vacuum forming and combinations therefore.

Figure 11:
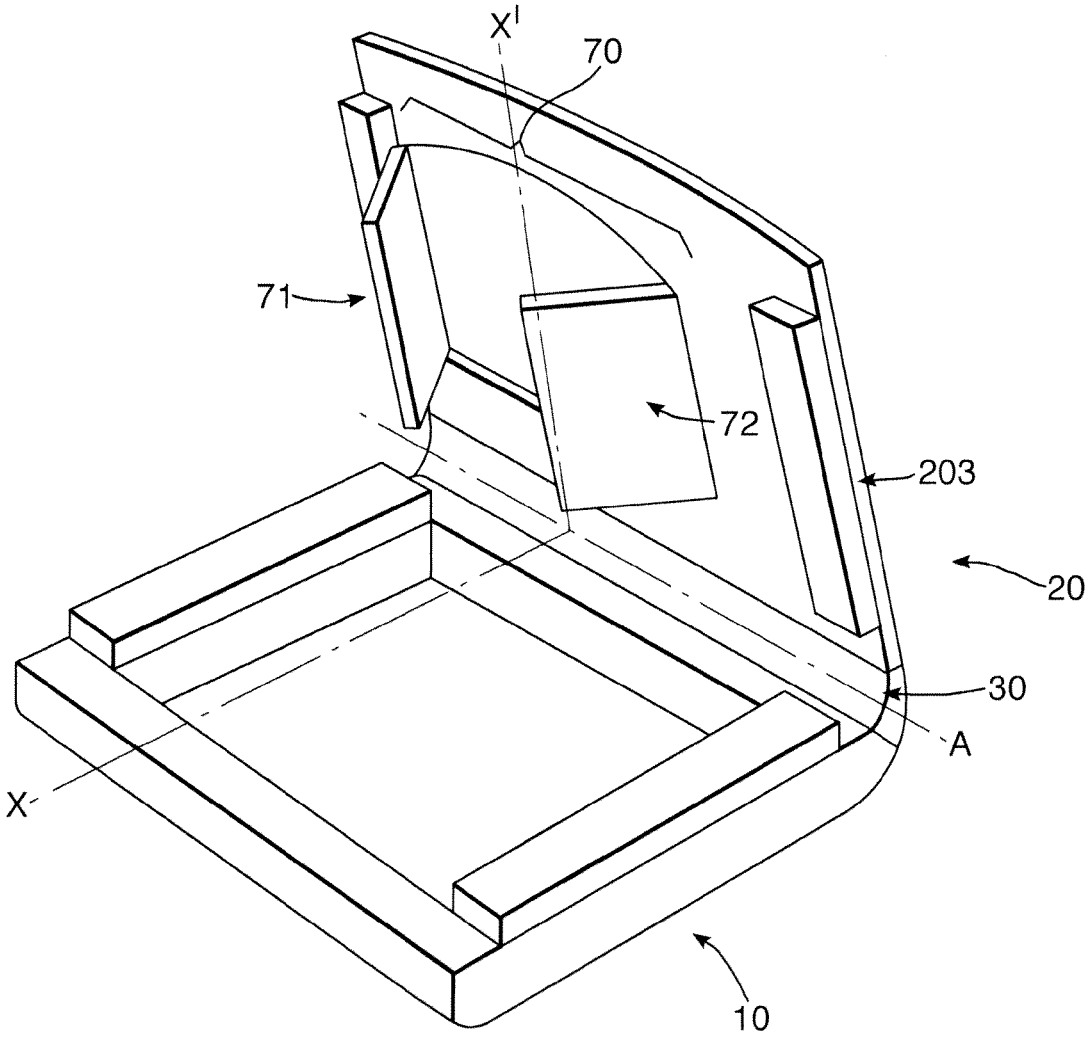
FIG. 11 illustrates a perspective view of an embodiment of the device (1) according to the invention.
Figure 12:
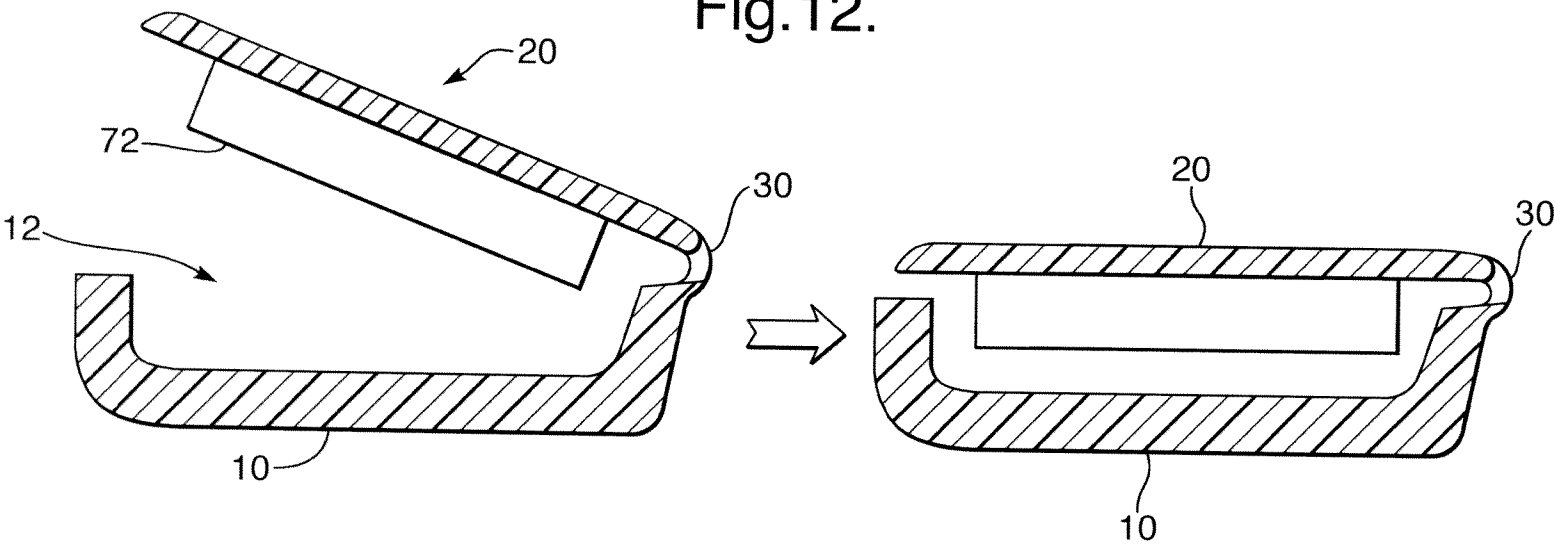
FIG. 12 (left) is a cross-sectional view of the embodiment of the device (1) shown in FIG. 11. The second portion (20) is in a remote relationship to the first portion (10) whereas in FIG. 12 (right) in a juxtaposed relationship.
Figure 13:
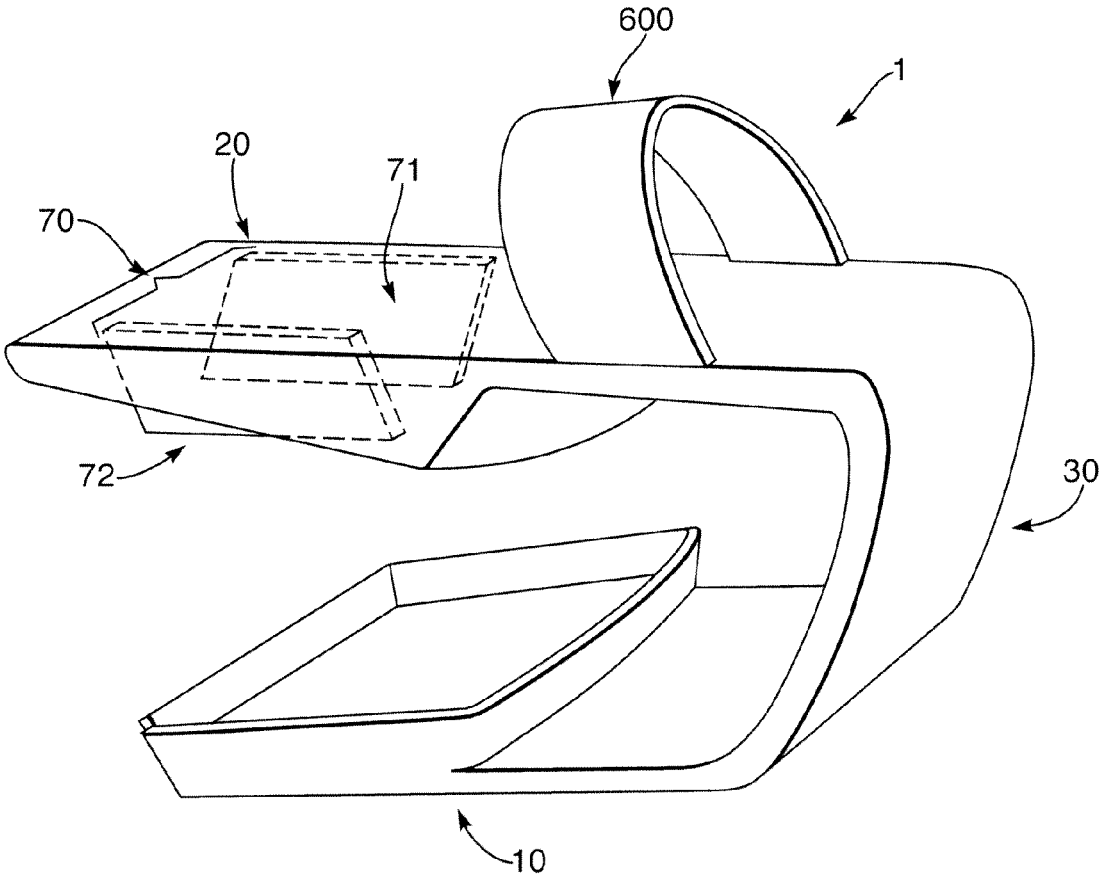
FIG. 13 shows a perspective view of an embodiment of the device (1) according to the invention.

The first portion (10) is movably joined to the second portion (20) by a connection (30) as shown in FIG. 11. A connection (30) between the first portion (10) and the second portion (20) is necessary to improve the perception of control over the device (1) in order for the latter to be guided by the consumers precisely and easily to each hair bundle (11). In addition, the connection (30) allows the consumers to move the device (1) from one hair bundle (11) to another without the need to adjust the position of the second portion (20) on the first portion (10) after each application. The connection (30) allows the first portion (10) and the second portion (20) to alternate from a remote relationship to a juxtaposed relationship. In the juxtaposed relationship the first fin (71) and/or the second fin (72), which will be described in more detail below, project within the cavity (12) as shown in FIG. 12. Once in the juxtaposed relationship, the first fin (71) and the second fin (72) project within the cavity so as not to leave enough space for the user to place the hair bundle between the first portion (10) and the second portion (20). Without wishing to be bound by theory it is believed that consumers are facilitated in the application of a hair treatment composition (15) with a device (1) having the first portion (10) and the second portion (20) movably joined and capable of alternating between a remote relationship and a juxtaposed relationship. To facilitate the transition from the remote relationship to the juxtaposed relationship, the device (1) may optionally comprise one or more fitting means (600). The fitting means (600) may be mounted on the first portion (10) and/or on the second portion (20) to accommodate the user's fingers as shown in FIG. 13.

Figure 14:
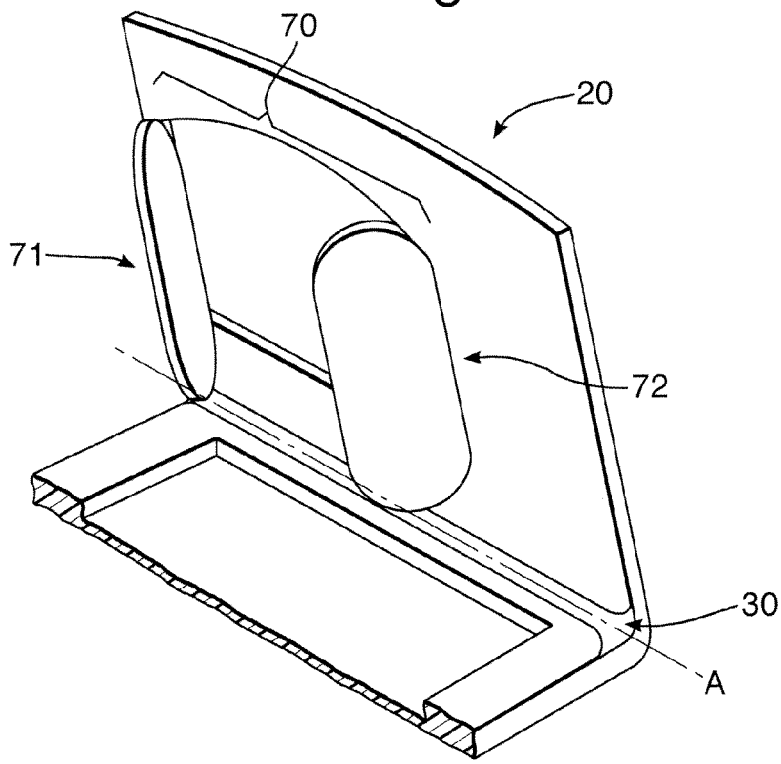
FIG. 14 is a perspective view of a part of an embodiment of the device (1). This embodiment shows the shape and the form of the first and second fins (71; 72) of the system (70).
Figure 15:
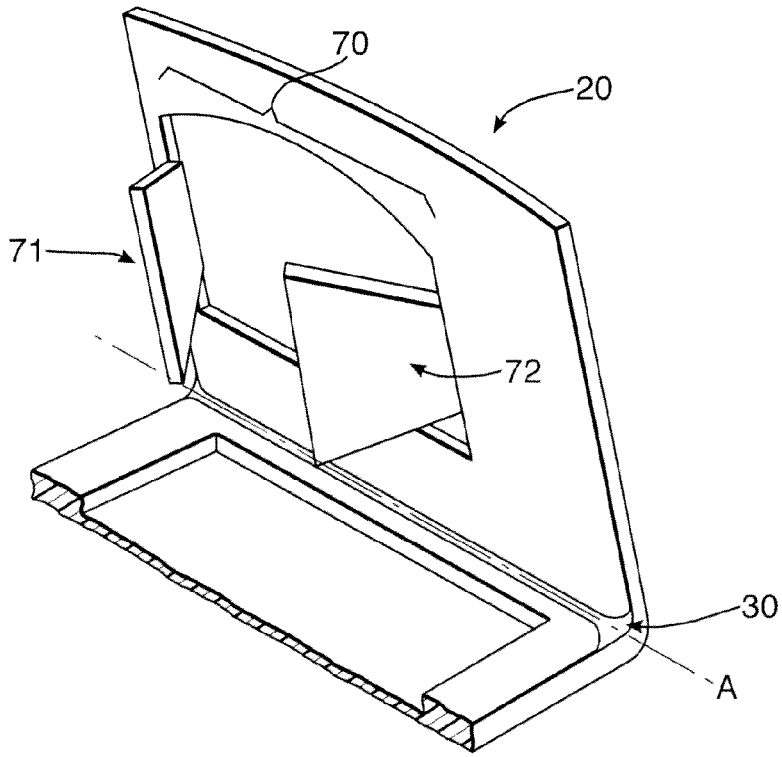
FIG. 15 is a perspective view of a part of another embodiment of the device (1). This embodiment shows the shape and the form of the first and second fins (71; 72) of the system (70).
Figure 16:
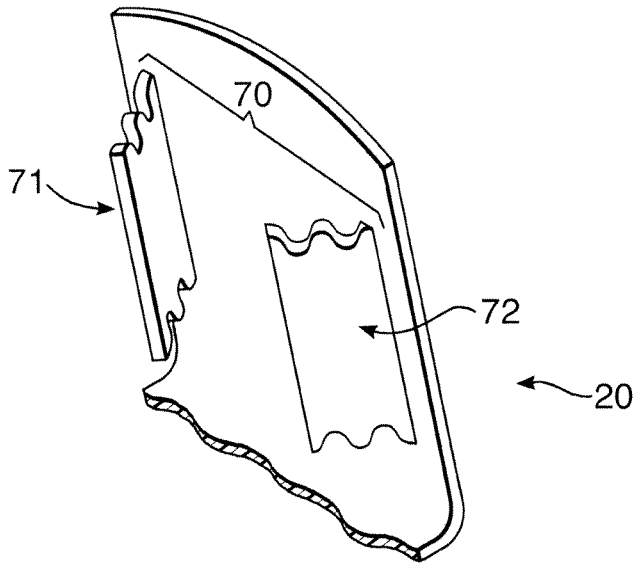
FIG. 16 is a perspective view of a part of an embodiment of the device (1). This embodiment shows the shape of the edges of the first and second fins (71; 72) of the system (70).
Figure 17:
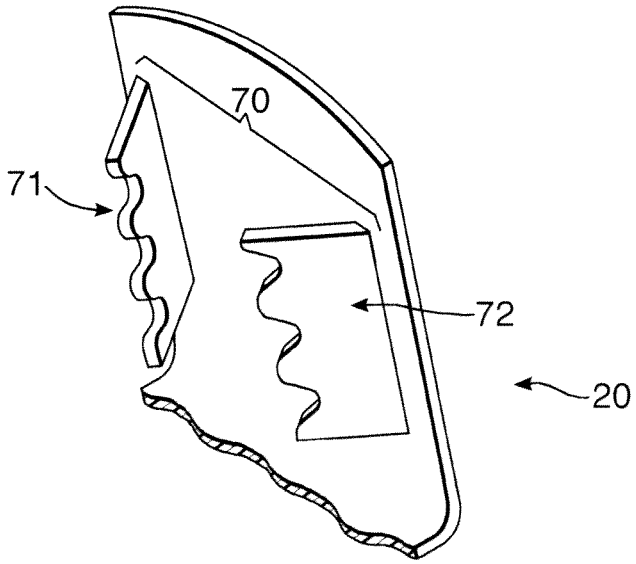
FIG. 17 is a perspective view of a part of an embodiment of the device (1). This embodiment shows the shape of the edges of the first and second fins (71; 72) of the system (70).
Figure 18:
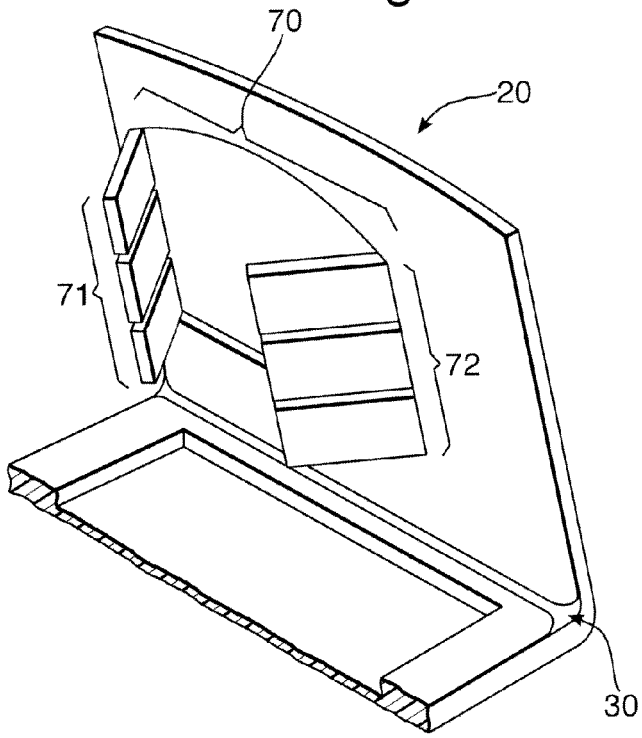
FIG. 18 illustrates a perspective view of a part of an embodiment of the device (1). This view shows the form and the shape of the first and second fins (71; 72) of the system (70).
Figure 19:
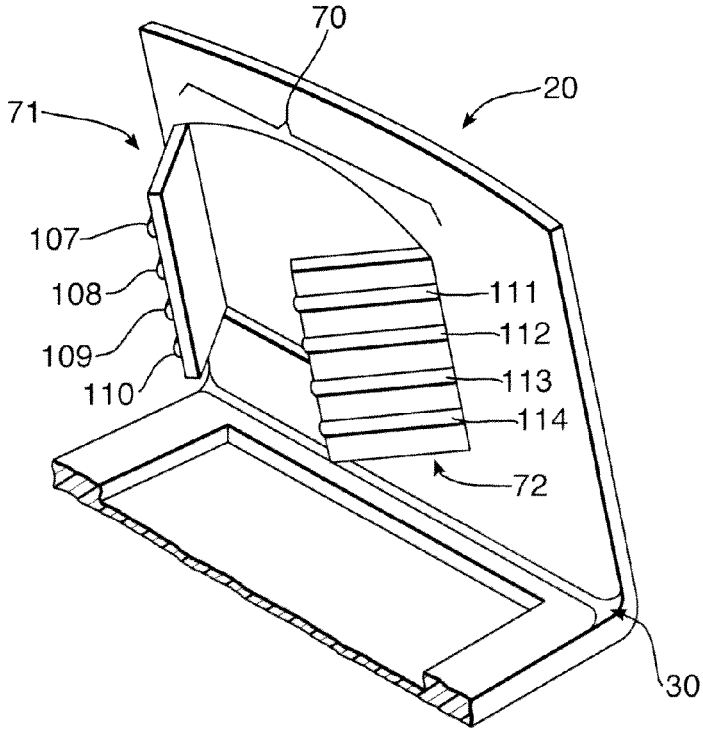
FIG. 19 is another perspective view of a part of an embodiment of the device (1). This view shows the embossments (107-114) on the first and second fins (71; 72) of the system (70).
Figure 20:
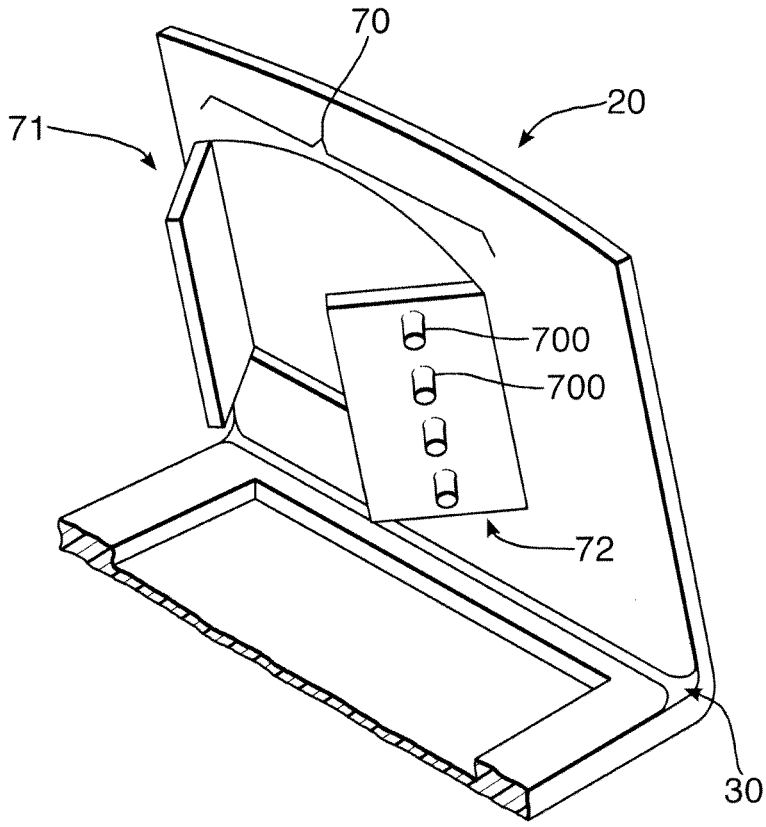
FIG. 20 is also a perspective view of a part of an embodiment of the device (1). This view shows tines (700; 700') on the first and second fins (71; 72) of the system (70).

Preferably, the connection (30) itself may re-establish the initial relationship of the first portion (10) to the second portion (20), preferably by springing back. The first portion (10) and the second portion (20) are movably joined by a connection (30) that fulfils the above described requirements, including the consumer's hand, for example through the thumb and index finger. In another aspect of the present invention, the first portion (10) and the second portion (20) are mounted at the ends of the arms of a tweezer-like or tong-like connection (30). In another aspect, the first portion (10) and the second portion (20) are movably joined by one or more hinges. When the connection (30) is one or more hinges, the angle between the first portion (10) and the second portion (20) may range between 20° and 275°, preferably between 30° and 190°, more preferably between 40° and 90°. Useful materials to manufacture the hinge may include those described herein above to manufacture said first potion (10) among others and combinations thereof. The hinge can be formed using a variety of manufacturing techniques known by one skilled in the art, including a 'live' injection moulded hinge, a leaf spring and pin hinge among others The device (1) according to the invention comprises a system (70) associated to the second portion (20). In one aspect of the present invention, when the second portion (20) is a plate, the system (70) is associated with the internal surface (201) of the plate. The system (70) comprises at least a first fin (71) and a second fin (72) as shown in FIGS. 5 to 10. It is irrelevant which fin is called the first fin (71) and the second fin (72). The term "fin" within the scope of the present invention defines a strip or sheet of material, which may have substantially constant or variable thickness. The shape of the first fin (71) and of the second fin (72) may vary. Rectangular, square, circular, elliptical, oblong shapes or combinations thereof may be used. Some examples are shown in FIGS. 14 and 15. Preferably the first fin (71) and the second fin (72) have substantially identical shape and form. More preferably, the first fin (71) and the second fin (72) have a parallelepiped form. This form imposes the presence of four edges and two faces, the latter having a rectangular shape. Each edge may be, independently from the others, straight, sinusoidal or crenulated as shown in FIGS. 16 and 17. The profile of the edges may be sharp or curvilinear. Similarly, the corner at those edges may be sharp or curvilinear. In one aspect of the present invention, the first fin (71) and/or the second fin (72) may be created by pieces joined together or adjacent one to the other as shown in FIG. 18. In another aspect of the present invention, at least one of the fins (71; 72) may comprise one or more modifications selected from the group consisting of embossments (107-114), imprints and combinations thereof as illustrated in FIG. 19. In another aspect of the present invention, the first fin (71) and/or the second fin (72) may comprise an additional feature selected from the group consisting of one or more tines (700; 700'), one or more bristles and combinations thereof as shown on FIG. 20.

Figure 21:
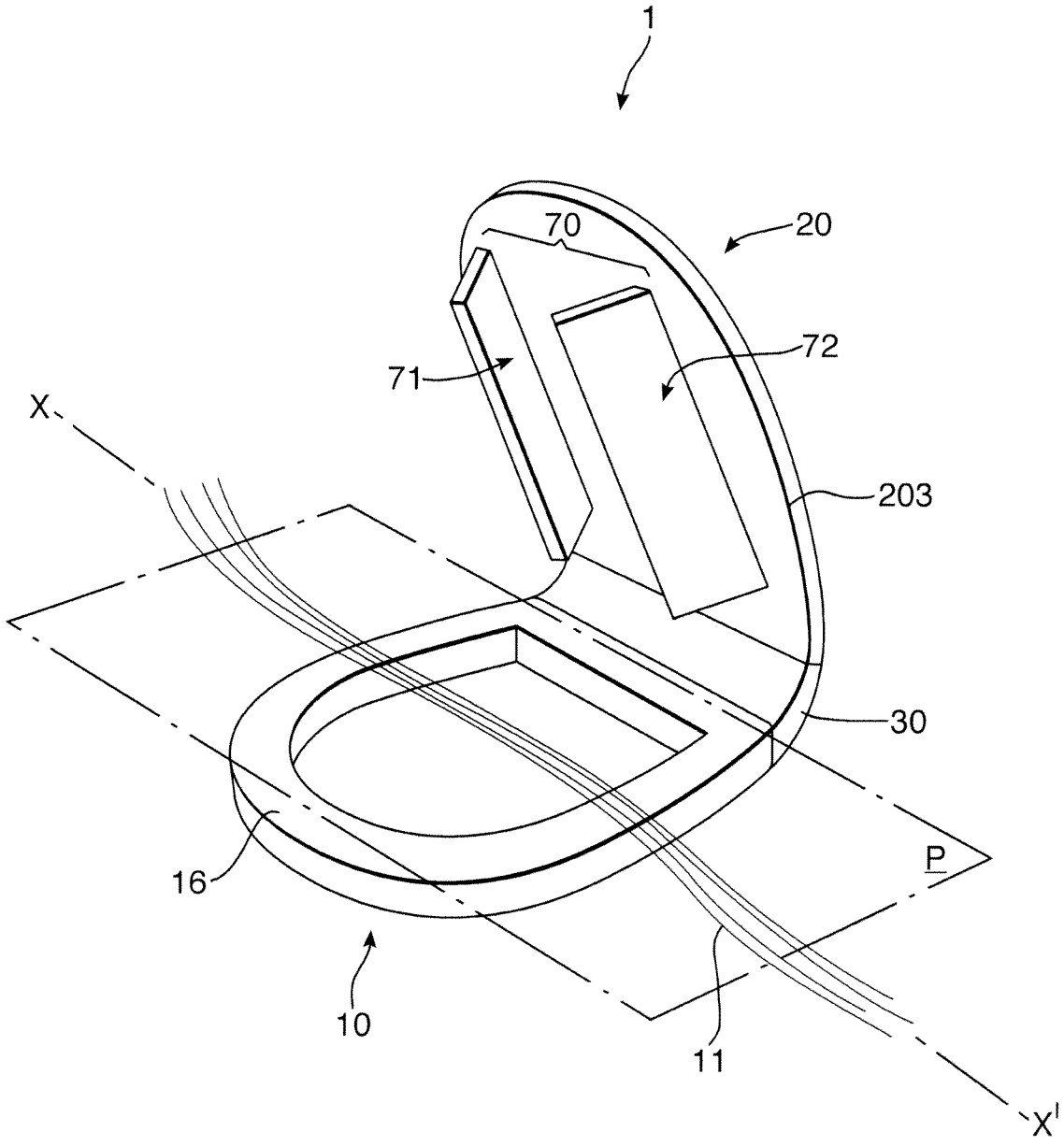
FIG. 21 is a perspective view of an embodiment of the device (1) according to the invention, showing plane P and a hair bundle (11).
Figure 22:
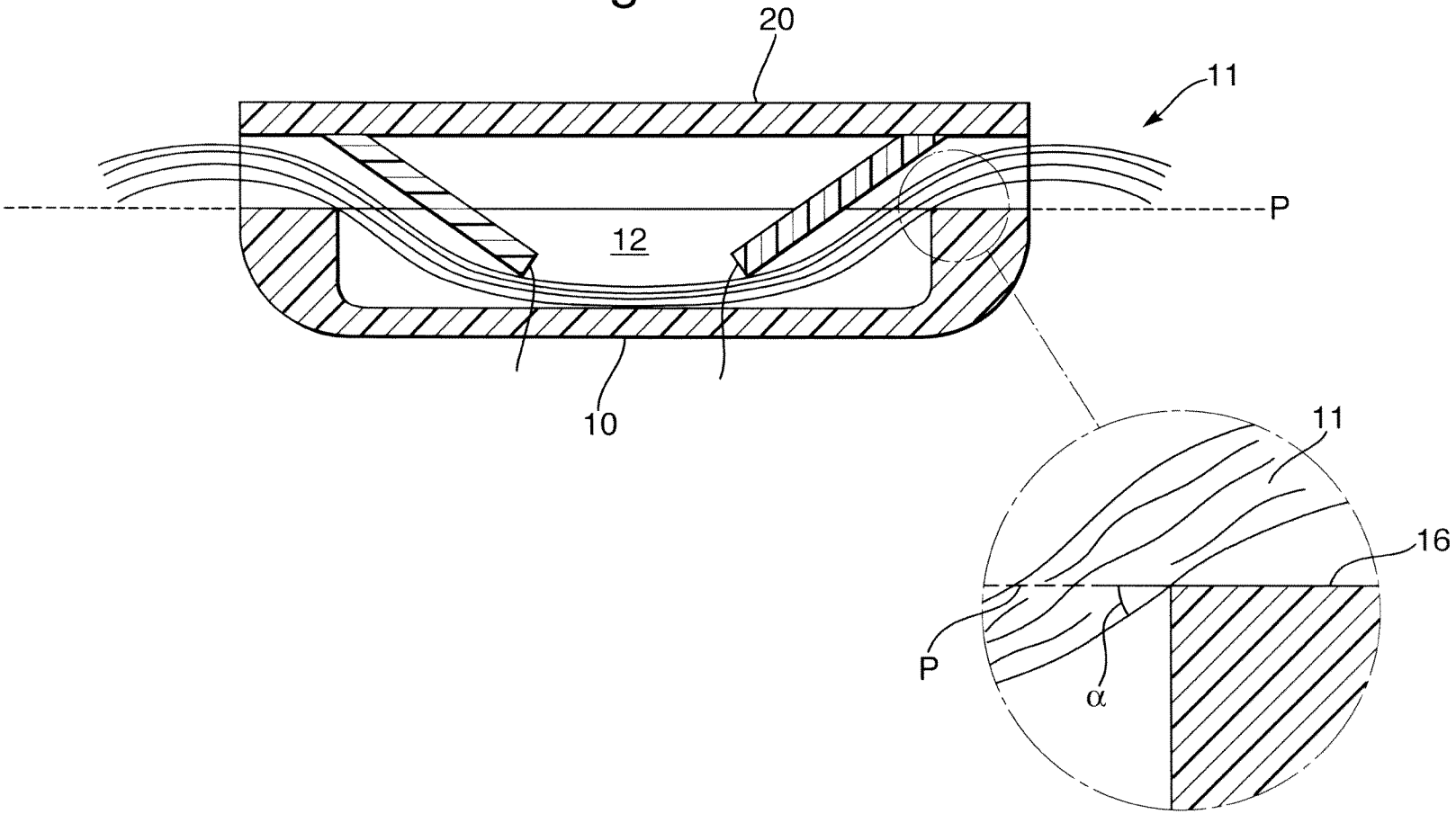
FIG. 22 is a cross-sectional view along axis X-X' of the embodiment of the device (1) shown in FIG. 21. In this view, the second portion (20) is in a juxtaposed relationship to the first portion (10). The hair bundle (11) is shown to form an angle $\alpha$ with plane P.

Within the device (1) a plane (P) as shown in FIG. 21 can be defined. When the hair bundle (11) is placed between the first portion (10) and the second portion (20), that hair bundle (11) is placed on plane (P). The hair bundle (11) is placed between the first portion (10) and the second portion (20) transversally to the first and second free distal edges (712; 722) of the first and second fins (71; 72). By bringing the second portion (20) into a juxtaposed relationship to the first portion (10), the hair bundle (11) is bent by the system (70) within the cavity (12) and forms with that plane (P) an acute angle, angle α, of from about 25° to about 55° as shown in FIG. 22. Preferably the angle α is from about 35° to about 55°, more preferably from about 35° to about 50°. By means of bending the hair bundle (11) within the cavity (12) through the system (70) and by moving the device (1) along the length of the hair bundle (11), preferably from roots-to-tips, while keeping the second portion (20) into a juxtaposed relationship to the first portion (10), the hair treatment composition (15) is applied to the hair bundle.

Figure 23:
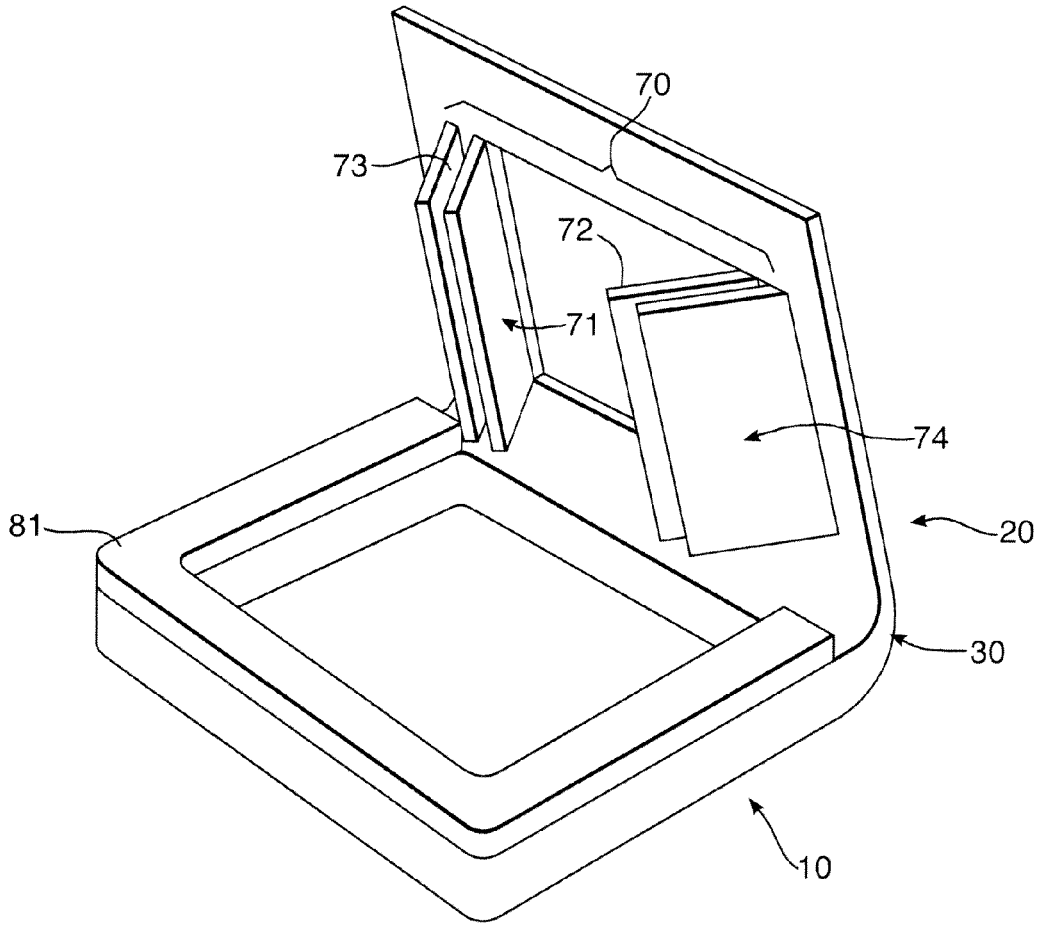
FIG. 23 is a perspective view of an embodiment of the device (1) according to the invention, wherein two additional fins (73; 74) are present along with the first and the second fins (71; 72) within the system (70).

According to the present invention, the system (70) may optionally further comprise one or more additional fins (73; 74) parallel to the first fin (71) and/or to the second fin (72) as shown in FIG. 23.

The system (70) comprising the first fin (71), the second fin (72) and any additional fin (73; 74), if present, may be manufactured within the same injection or co-injection mould used to manufacture the device (1). Polypropylene, acrylonitrile butadiene styrene, acrylic, acrylonitrile styrene acrylate, ethylene vinyl alcohol, polycarbonate, polystyrene, latex, silicone or thermo plastic elastomer (TPE) may be used. Preferably, the material is selected from the group consisting of TPE, silicone and combinations thereof. Preferable the fins are flexible. Useful manufacturing processes may include, but are not limited to, injection moulding, co-injection moulding, over moulding, in-mould assembly, compression moulding, blow moulding, thermo or vacuum forming.

When the system (70) is independently manufactured from the device (1), it may be manufactured using various materials as described herein above. The system (70) may be associated with the second portion (20) in various ways. Generally the system (70) may be associated with the second portion (20) by means selected from the group consisting of chemical means, mechanical means or combinations thereof. Useful methods are, but not limited to, heat welding including pressure, ultrasonic forces, radio or high frequencies, co-extruded heat activated adhesives, two-side tape, thermo-set, hot melt and cold seal, adhesion or extrusion lamination. Mechanical interlock or entanglement such as Velcro®, clamping, snap locks, sealing beads, locking pins and magnetism may also be used to associate the system (70) to the second portion (20).

Irrespective of the manner in which the system (70) is associated with the second portion (20), the first fin (71) and the second fin (72) project within the cavity (12) so that the first and the second free distal edges (712; 722) are substantially perpendicular or substantially oblique but never substantially parallel to an axis A as shown in FIGS. 9, 10, 11, 14 and 15.

A first metering layer (81) may extend upon at least a portion of the control zone (16). Preferably, a second metering layer (82) extends upon at least a portion of the second portion (20). When the second portion (20) is a plate, the second metering layer (82) extends upon at least a portion of the internal surface (201) of the plate. More preferably the second metering layer (82) extends upon at least a portion of the internal surface (201) of the plate and runs along at least a portion of the contour (203) of the plate. The first metering layer (81) and the second metering layer (82) may be continuous or discontinuous. By discontinuous is meant that the first metering layer (81) and the second metering layer (82) may form loci or islets or may be interrupted. Preferably the first metering layer (81) and the second metering layer (82) are positioned such that when the first portion (10) and the second portion (20) are brought to a juxtaposed relationship, said first metering layer (81) and said second metering layer (82) are substantially juxtaposed.

The first metering layer (81) and the second metering layer (82) according to the present invention may have a combined thickness of from about 0.40 mm to about 21.88 mm, preferably from about 0.63 mm to about 17.50 mm and even more preferably from about 0.79 mm to about 13.13 mm. The calliper of said first and second metering layer (81; 82) was determined using the general procedure described in "ASTM D 5736-95 Standard Test Method for Thickness of Highloft Non-Woven Fabrics". With regard to the width, preferably the first metering layer (81) has substantially the same width as the control zone (16).

Without wishing to be bound by theory, it is believed that the first metering layer (81) and the second metering layer (82), as described herein further enhance the functionality of the control zone (16). The first metering layer (81) and the second metering layer (82) not only help to prevent dripping of the hair treatment composition (15) from the device (1), but also increase the evenness of the application of the hair treatment composition (15) to the hair bundle's entire length. Evenness is an important aspect in the application of a hair treatment composition (15), especially when the hair treatment composition (15) is a highlighting composition or a dyeing composition. The permanent effect provided by those hair treatment compositions (15) is not immediately visible after the application and if the result is not appealing, it may not easily be reversed.

The first metering layer (81) and the second metering layer (82) are independent from each other, comprising a material selected from the group consisting of non-wovens, foams and combinations thereof.

Suitable non-wovens may be comprised of natural or synthetic fibers selected from acetate fibers; acrylic fibers; cellulose ester fibers; modacrylic fibers; polyamide fibers; polyester fibers; polyolefin fibers; polyvinyl alcohol fibers; rayon fibers; polyethylene foam; keratin fibers; cellulose fibers; textile fibers such as silk; cotton and wool fibers and combinations thereof. The non-wovens may be comprised of monocomponent fibers, such as a polyolefin or polyester, or bicomponent fibers, such as a sheath/core fiber or side by side fiber of polyethylene/polypropylene or polyethylene/polyester, or bi-constituent fibers comprised by a blend of two or more thermoplastic polymers.

Examples of suitable Carded non-wovens include; PGI 214, Libeltex 01-766 DI-4, PGI 4183, PGI 172-071-11, PGI 172-071-12, PGI 172-290-3, PGI 172-290-4, PGI 172-290-6, PGI 172-290-7 and PGI 172-290-12. Further examples of suitable non-wovens include USFELT F-50 and Ahlstrom 18008

Foam materials are made from low density elastomers, plastics, and other materials with various porosities and may be selected from open cellular foams; closed cellular foams; flexible foams and reticular foams and syntactic foams which can be fabricated into finished shapes using moulding, casting, extrusion, pultrusion, machining, thermal forming, plastic welding, blow moulding, rapid prototyping techniques, grinding and/or other specialized processes. The foam materials may be composed of a variety of chemical systems including Acrylonitrile-Butadiene-Styrene; Acrylics; Epoxy resins; Fluoropolymers; isoprene-styrene and Styrene-Butadiene-Styrene; Synthetic rubbers or elastomers based on a variety of systems such as silicone, polyurethane, polyolefin and neoprene; Nitrile rubbers; plastics or elastomers formed from natural or plant-based raw materials such as natural rubber (polyisoprene) or vulcanized fibre; water-based and water-borne resins and latex materials. Chemical systems for foams may include ethylene copolymer, expanded polyethylene, polycarbonate, polyester, polyether, polyetherimide, polyimide, polyolefin, polypropylene, phenolic, polyurea, and vinyl. Examples of suitable foams include; Recticel Bulpren D32133; Recticel D27150 B and Recticel Bulpren S31048

The first metering layer (81) and the second metering layer (82) of the present invention may also include composite materials having one or more plies of the same or different materials superimposed physically, joined together continuously (laminated), in a discontinuous pattern, or by bonding the external edges at discrete loci.

The first metering layer (81) and the second metering layer (82) may be attached to the first portion (10) and second portion (20), respectively, in any suitable method providing that method does not destroy or alter the performance of the metering layers (81; 82) within the scope of the present invention. Useful methods are, but not limited to, heat welding including pressure, ultrasonic forces, radio or high frequencies, co-extruded heat activated adhesives, electro static adhesions such as flocking by fibres. The first and second metering layers (81; 82) may also be attached through adhesive, including double sided tape, thermo-set, hot melt and cold seal, adhesion or extrusion lamination. Mechanical interlock or entanglement such as Velcro®, clamping, snap locks, sealing beads, locking pins and magnetism may also be used to adhere.

PREFERRED EMBODIMENTS

The following preferred embodiments are directed to a device (1) for creating hair bundle effects.

Figure 24:
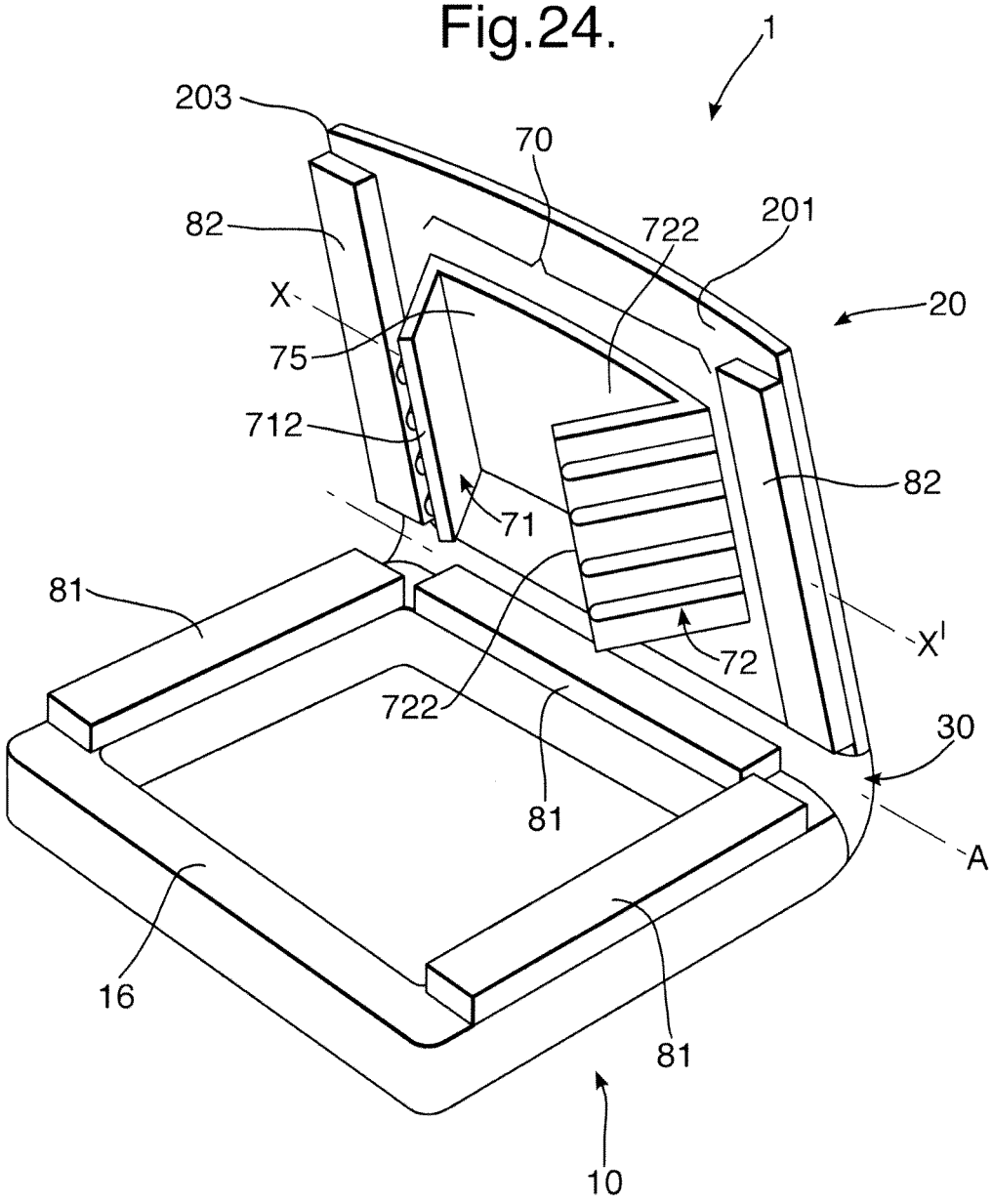
FIG. 24 is a perspective view of one of the preferred embodiments of the device (1) according to the invention.
Figure 25:
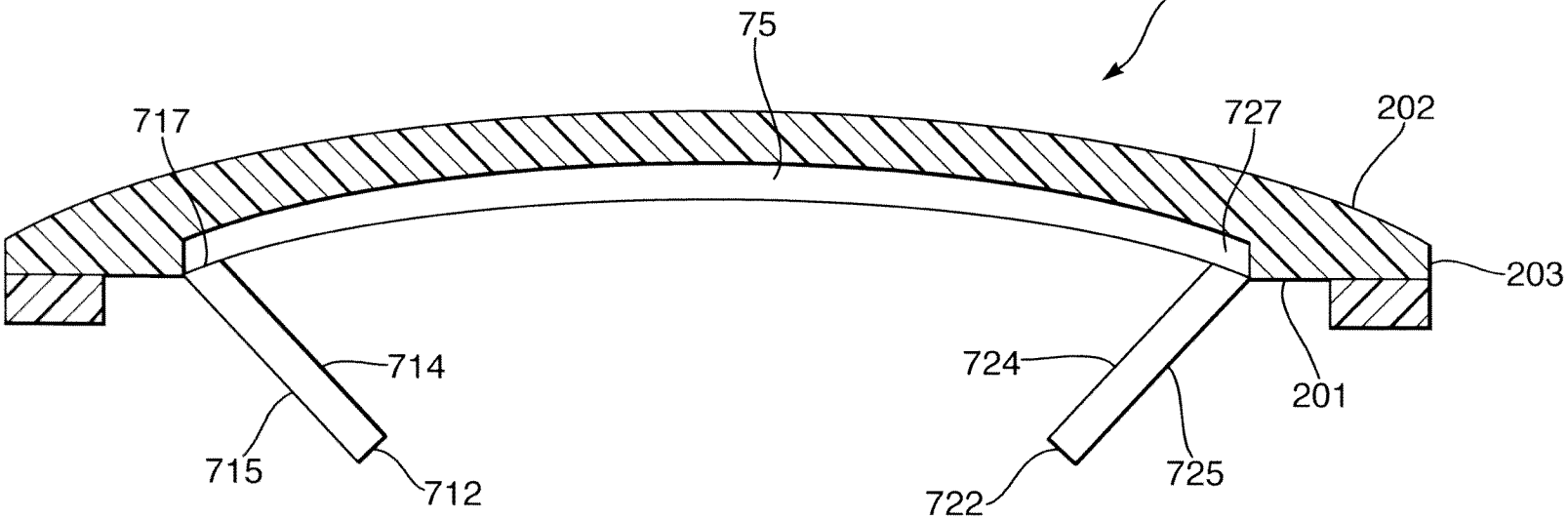
FIG. 25 is a cross-sectional view along axis X-X' of the embodiment of the device (1) shown in FIG. 24.
Figure 26:
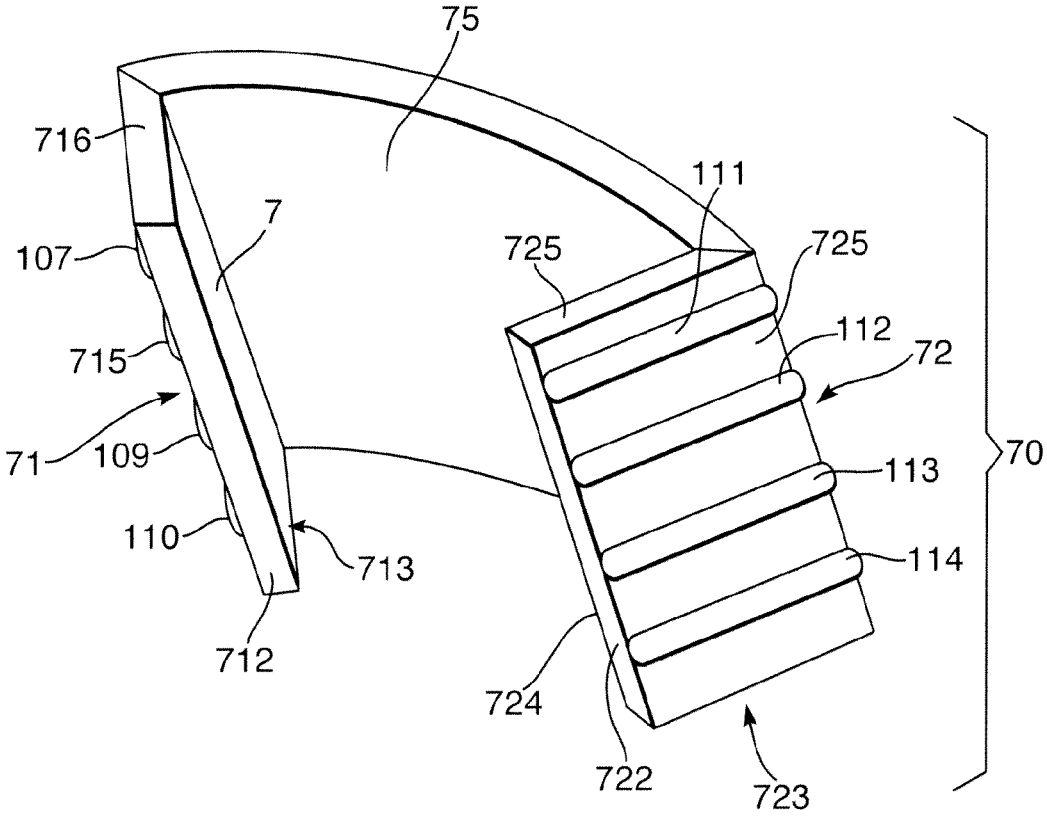
FIG. 26 is a perspective view of the system (70) shown in FIG. 24.

FIG. 24 illustrates a first preferred embodiment of the device (1) according to the invention. In this embodiment the second portion (20) is a plate which comprises an internal surface (201) and an external surface (202). The system (70) is associated with the internal surface (201) of the plate. The system (70) comprises a first fin (71) and a second fin (72). The plate is concave between the first fin (71) and the second fin (72) as shown in FIGS. 24 and 25, but substantially flat elsewhere. Both the first and the second fins (71; 72) have a parallelepiped form. As previously described, this form dictates the presence of four edges and two faces. The first free distal edge (712) of the first fin (71) points towards the second free distal edge (722) of the second fin (72). In this embodiment the first distal edge (712) is substantially parallel to the second free distal edge (722) and both the first and the second free distal edges (712; 722) extend substantially perpendicular to axis A, as shown in FIG. 24. The other remaining edges on the first fin (71) and on the second fin (72) are, as shown in FIGS. 24, 25 and 26, the first and the second trailing edges (713; 723) on the side of the connection; the first and second leading edges (716; 726) opposite to the first and second trailing edges (713; 723); and the first and second upper edges (717; 727). The two faces on the first fin (71) are the first internal surface (714) and the first external surface (715); on the second fin (72) the second internal surface (724) and the second external surface (725). Preferably, the surface area of each of those faces (714; 724; 715; 725) is from about 0.25 $cm^2$ to about 30.00 $cm^2$, preferably from about 0.50 $cm^2$ to about 15.00 $cm^2$, more preferably from about 1.00 $cm^2$ to about 5.00 $cm^2$. In this embodiment the first external surface (714) of the first fin (71) and the second external surface (724) of the second fin (72) comprise each four embossments (107-114) as shown in FIG. 26. The embossments (107-114) run straight on the first and on the second external surfaces from the first upper edges (717; 727) to the free distal edges (712; 722). Without wishing to be bound by theory it is believed that one or more modifications on the first and/or second fins (71; 72) such the embossments (107-114) described herein may help to splay the hair bundle (11) and expose the independent hair fibres comprised therein to the hair treatment composition (15) within the cavity (12).

As shown in FIGS. 24, 25 and 26 the system (70) in this embodiment further comprises a connecting element (75). The connecting element (75) connects the first upper edge (717) of the first fin (71) to the second upper edge (727) of the second fin (72). The connecting element (75) itself is associated with the internal surface (201) of the plate. The connecting element (75) may be formed by one single piece, by multiple independent pieces or by multiple independent pieces joined together chemically or mechanically to form a single piece. The connecting element (75) may be manufactured from a material as described above for the system (70). The connecting element (75) may be manufactured separately from the plate and the system (70) or together to one or both elements. In this embodiment, the system (70) comprising the first fin (71), the second fin (72) and the connecting element (75) is over-moulded onto the internal surface (201) of the plate. Alternatively, the system (70) may be manufactured independently of the plate and then subsequently associated to the internal surface (201), for example by cold seal, two-sided tape or mechanical interlock.

It should be understood that the connecting means (75) is not foreseen to connect, in this or in variant embodiments, any portion of the first fin (71) to any portion of the second fin (72) in a way that it could provoke displacement of the hair treatment composition (15) when the plate is brought into a juxtaposed relationship to the first portion (10). For example, the connecting means (75) is excluded from connecting the first free distal edge (712) to the second free distal edge (722).

The connecting element (75) helps maintain the first fin (71) and the second fin (72) orientation in such a way that the first free distal edge (712) points toward the second free distal edge (722) irrespectively of the shape of the plate. The connecting element (75) also helps the association of the system (70) to the internal surface (201) of the plate.

A first metering layer (81) extends upon a part of the control zone (16) of the first portion (10) as shown in FIG. 24. In this specific embodiment the thickness of the first metering layer (81) is from about 1.0 mm to about 1.5 mm. A second metering layer (82) extends upon the internal surface (201) of the plate and runs along the contour (203) of the plate as shown in FIG. 24. The first and second metering layers (81; 82) which extend parallel to the free first and second distal edges (712; 722) are selected from a non-woven whilst the first metering layer (81) extending upon the control zone (16) adjacent to the connection (30) is a closed polyethylene foam.

The overall form of the device (1) is substantially rectangular. An overall rectangular shape is advantageous as it leaves a negligible space between the first and second upper edges (717; 727) on the internal surface (210) of the plate and the contour (203) of the plate as shown in FIG. 24. Consequently, it is more intuitive for consumers to place the hair bundle (11) substantially perpendicular to the free distal edges (712; 722) instead of pinching the hair bundle (11) with that leading part of the device (1) itself.

Figure 27:
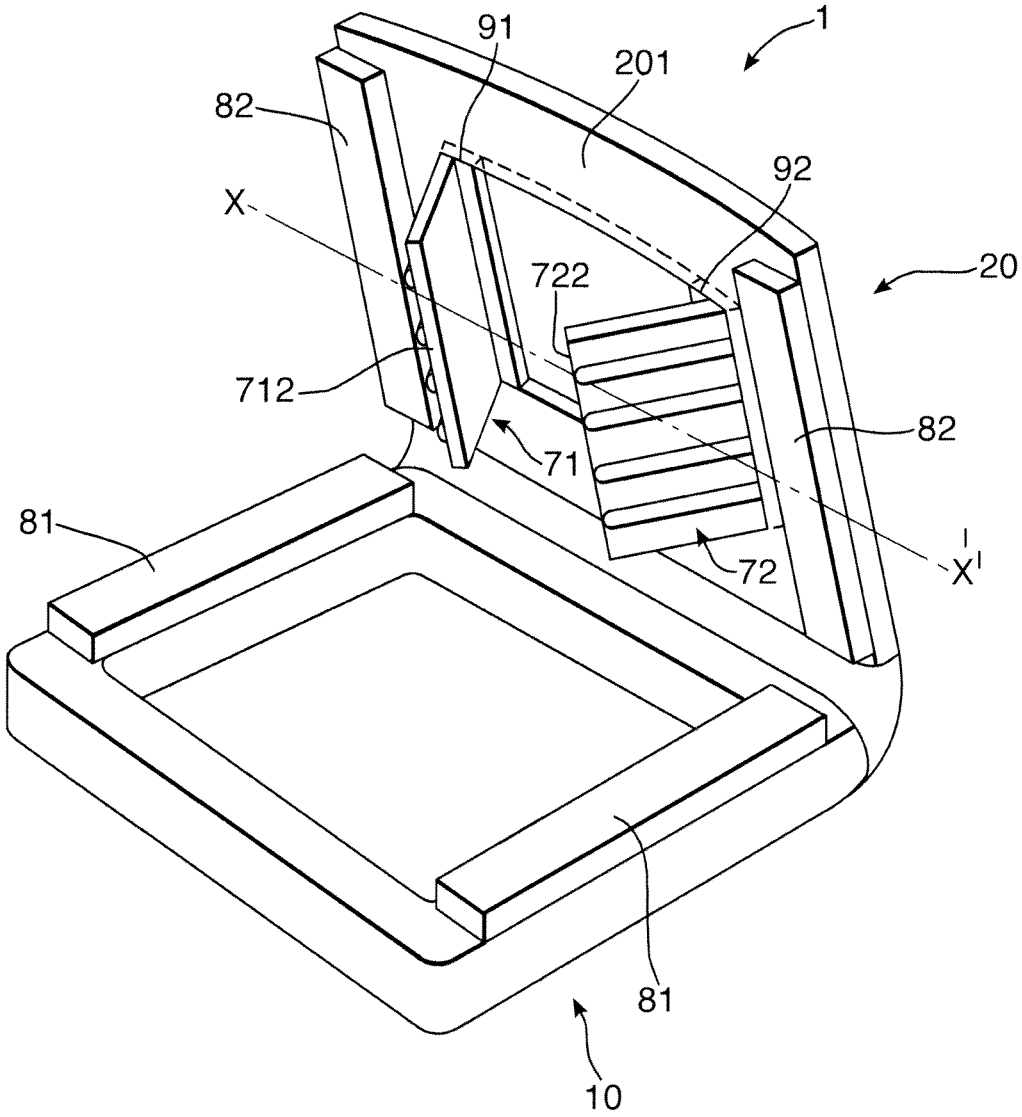
FIG. 27 is a perspective view of another of the preferred embodiments of the device (1) according to the invention.
Figure 28:
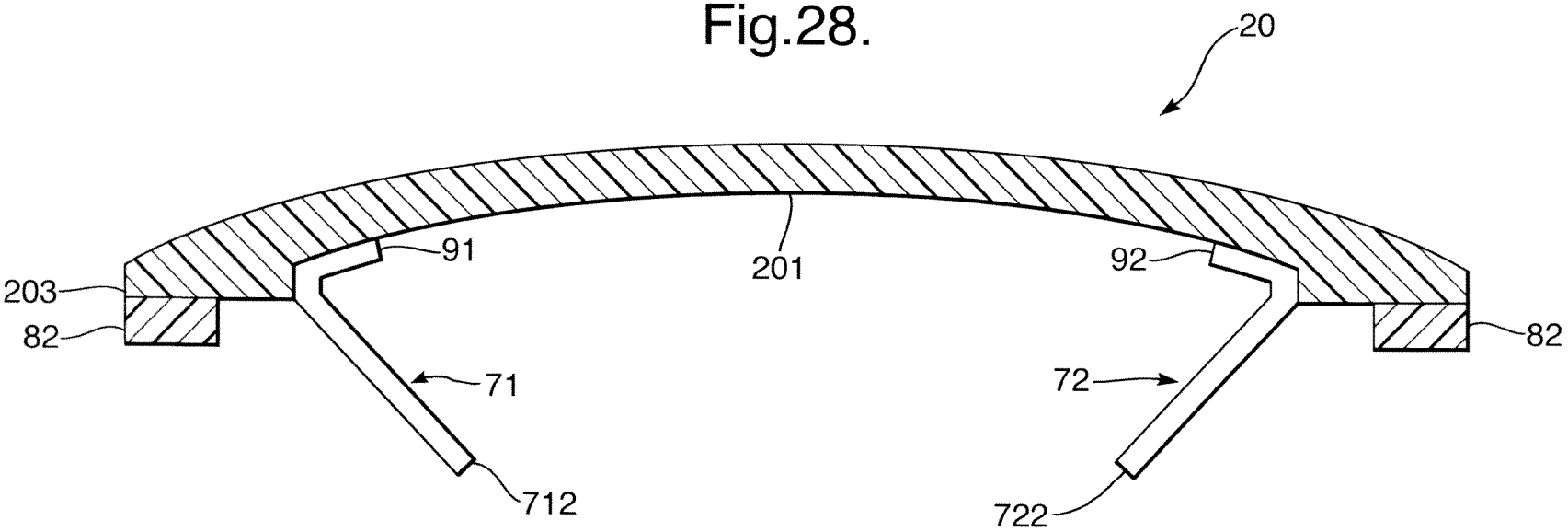
FIG. 28 is a cross-sectional view along axis X-X' of the embodiment of the device (1) shown in FIG. 27.

FIG. 27 illustrates an alternative of the embodiment shown in FIG. 24. As shown in FIG. 27, the connecting element (75) of the system (70) shown in FIG. 24 has been replaced by a first supporting means (91) and a second supporting means (92). The first and the second supporting means (91; 92) help to maintain the first and the second fins (71; 72) oriented so that the first free distal edge (712) points towards the second free distal edge (722) as shown in FIG. 28. The first and second supporting means (91; 92) may be manufactured within the same injection or co-injection mould used for manufacturing the device (1). Alternatively, the fins (71; 72) and their respective supporting means (91; 92) may be manufactured during the same injection mould and then associated to the internal surface (201) of the plate by mechanical means, chemical means or both.

Figure 29:
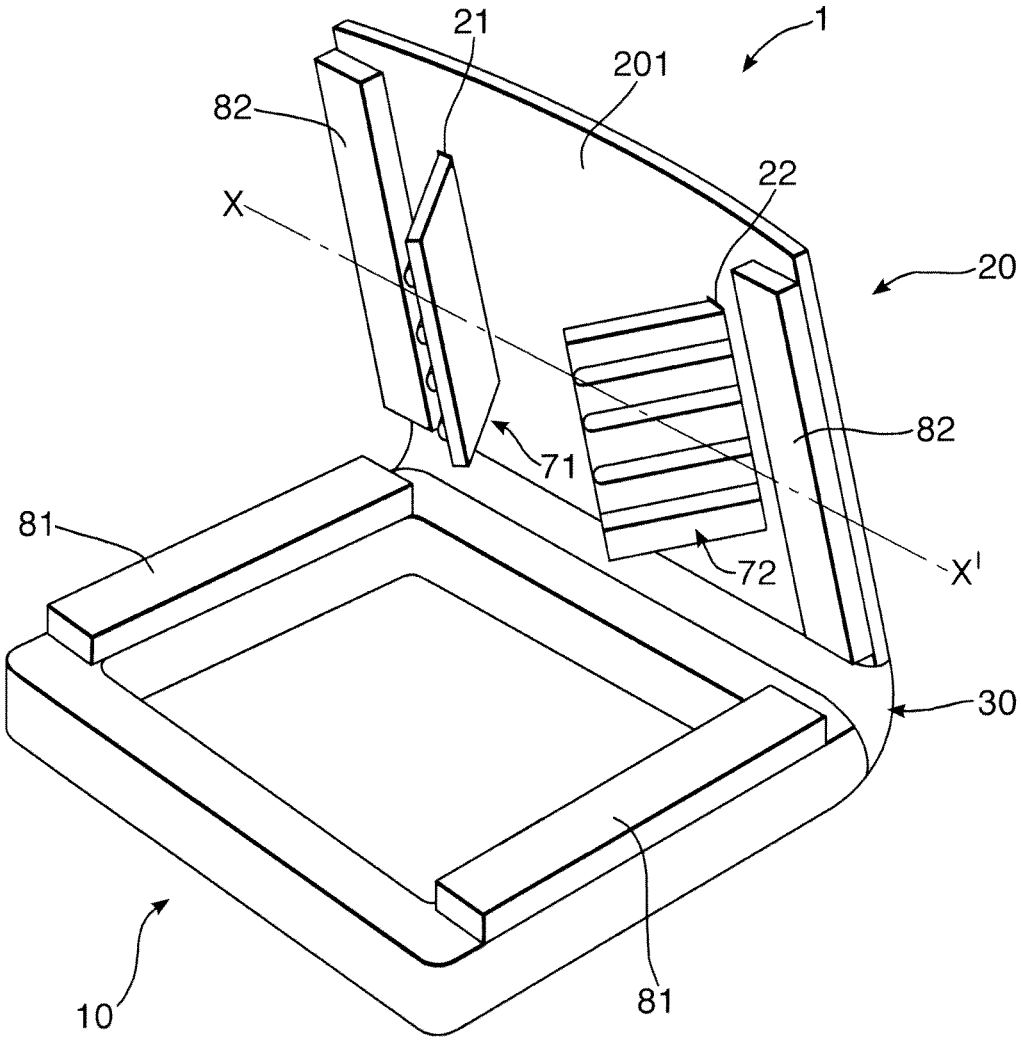
FIG. 29 is a perspective view of another of the preferred embodiments of the device (1) according to the invention.
Figure 30:
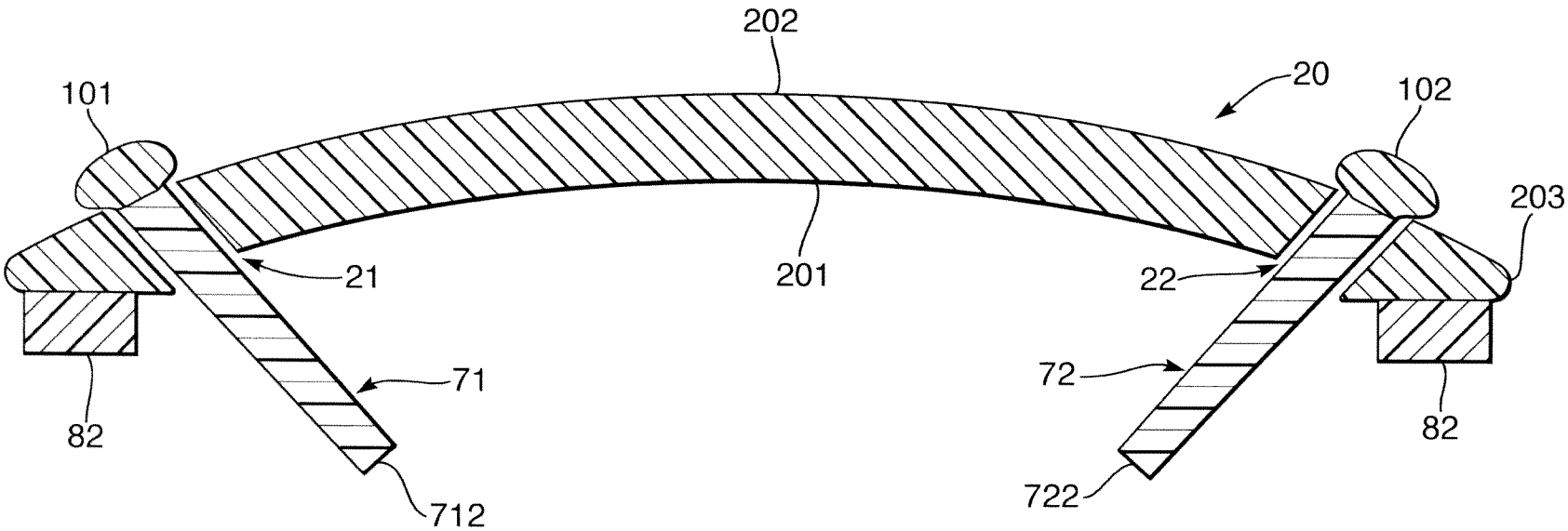
FIG. 30 is a cross-sectional view along axis X-X' of the embodiment of the device (1) shown in FIG. 29.

FIG. 29 represents another embodiment according to the device (1) described herein. The second portion (20) is a plate which comprises an internal surface (201) and an external surface (202). A first slot (21) and a second slot (22) as shown in FIGS. 29 and 30 are arranged through the plate. The first fin (71) is engaged within the first slot (21) and the second fin (72) is engaged within the second slot (22). The first slot (21) and the second slot (22) are arranged through the plate so that when the first fin (71) and the second fin (72) of the system (70) are engaged within, the first free distal edge (712) of the first fin (71) points towards the second free distal edge (722) of the second fin (72).

In this embodiment the first upper edge (717) of the first fin (71) and the second upper edge (727) of the second fin (72) are levelled with the external surface (202) of the plate. A first holding knob (101) is attached to the first upper edge (717) and a second holding knob (102) is attached to the second upper edge (727) as shown in FIG. 30. The first and the second holding knobs (101; 102) help maintain the first fin (71) and the second fin (72) engaged within the first and the second slot (21; 22) so that during use the fins (71; 72) will neither be pushed behind the external surface (202) nor will slide out from their respective slots (21; 22). The first and the second holding knobs (101; 102) are preferably co-moulded with the system (70) and manufactured from a material as described above for the system (70).

Figure 31:
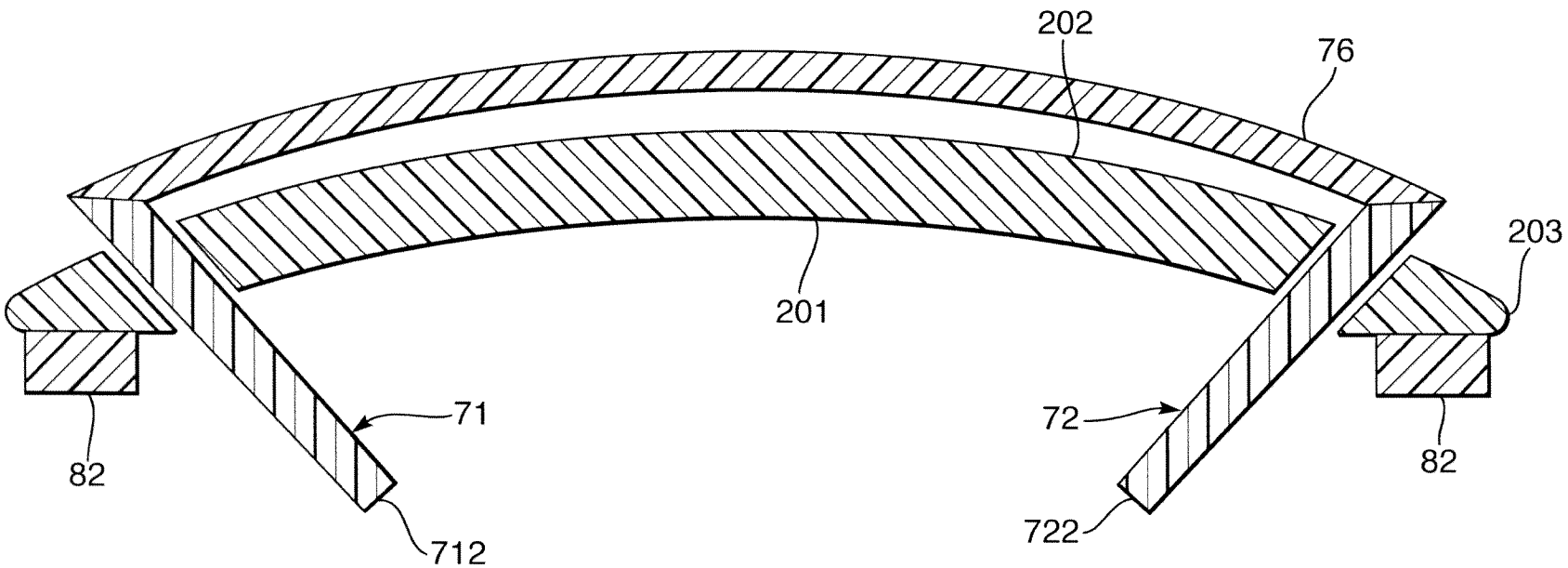
FIG. 31 is also a cross-sectional view along axis X-X' of an alternative embodiment of the device (1) shown in FIG. 29, wherein the first and second holding knobs (101; 102) are substituted by a joining member (76).

In FIG. 31 is represented a variation of the embodiment as shown in FIG. 29. In this embodiment, a part of the first fin (71) and a part of the second fin (72) protrude beyond the external surface (202) outside the first slot (21) and the second slot (22). The system (70) further comprises a joining member (76) which connects the protruding part of the first fin (71) to the protruding part of the second fin (72) behind the external surface (202). Preferably, the joining member (76) connects the first upper edge (717) of the first fin (71) to the second upper edge (727) of the second fin (72). Alternatively, the joining member (76) may connect any part of the protruding part of the first fin (71) to any part of the protruding part of the second fin (72) as long as these parts are protruding behind the external surface (202) of the plate. As described above for the connecting means (75), the device (1) of the present invention excludes a joining member (76) or any equivalent thereof connecting portions of the fins (71; 72) beneath the internal surface (201) in a way that it could provoke displacement of the hair treatment composition (15).

It should be understood that combinations of the features of the embodiments described above and illustrated in FIGS. 24 to 31 are possible within the scope of the present invention. For example the first and the second fins (71; 72) may be engaged within the two slots (21; 22) through the plate and protrude behind the external surface (202). A joining member (76) may connect the two upper edges (717; 727) while a connecting means (75) associated with the internal surface (201) connects the parts of the first and second fins (71; 72) immediately beneath the internal surface (201). In another embodiment, not shown herein, the first and the second holding knobs (81; 82) may be combined with either a connecting means (75) or with a joining member (76) or with both. Similarly, a connecting means (75) may be combined with a joining member (76).

As apparent from FIGS. 24 to 26, the device (1) preferably has an overall rectangular shape. More preferably the first fin (71) and the second fin (72) have a parallelepiped form. The first metering layer (81) in these preferred executions extends upon at least two portions of the control zone (16). More preferably, the first metering layer (81) extends upon the two portions of the control zone (16) and substantially parallel to the first and second free distal edges (712; 722) of the first and second fins (71; 72). Even more preferably, the first metering layer (81) extends upon at least a portion of the control zone (16) adjacent to the connection (30) as shown in FIG. 24 or on a portion of the control zone (16) on the side of the connection (30). The second metering layer (82) extends upon at least a portion of the internal surface (201) of the plate and runs along the contour (203) of the plate as shown in FIGS. 24 to 31, so that when the second portion (20) is in a juxtaposed relationship to the first portion (10) the second metering layer (82) overlaps the first metering layer (81).

The first metering layer (81) and the second metering layer (82) extend upon the control zone (16) and the internal surface (201) in a continuous or discontinuous manner, preferably in a discontinuous manner as shown in FIG. 24. The hair bundle (11) is placed between the first and second portions (10; 20) substantially perpendicular to the first and second free distal edges (712; 722), when the plate is brought into a juxtaposed relationship to the first portion (10), it is bent within the cavity (12). The device (1) is then moved along the length of the hair bundle (11) to complete the application. Hence, the first metering layer (81) and the second metering layer (82) as shown in FIGS. 24 to 31 provide several advantages. Firstly, they splay the hair fibres composing the hair bundle (11) before the latter enters the device (1). In this first aspect, the first and the second metering layers (81; 82) may either substitute the embossments (107-114) of the fins (71; 72) or they may cooperate with them. Secondly, the first metering layer (81) and the second metering layer (82) meter the hair treatment composition (15) on the hair bundle (11) as the hair bundle (11) leaves the device (1). In this second aspect, the first metering layer (81) and the second metering layers (81; 82) avoid any excess hair treatment composition (15), remaining on the hair bundle (11), which can then leak onto the remaining unselected hair. Thirdly, the first metering layer (81) and the second metering layer (82) favour the distribution of the hair treatment composition (15) along the length and the width of the hair bundle (11) when the device (1) is moved along the length of the hair bundle (11) itself. In this third aspect, the first metering layer (81) and the second metering layer (82) provide for an even application of the hair treatment composition (15).

Additional Features

Figure 32:
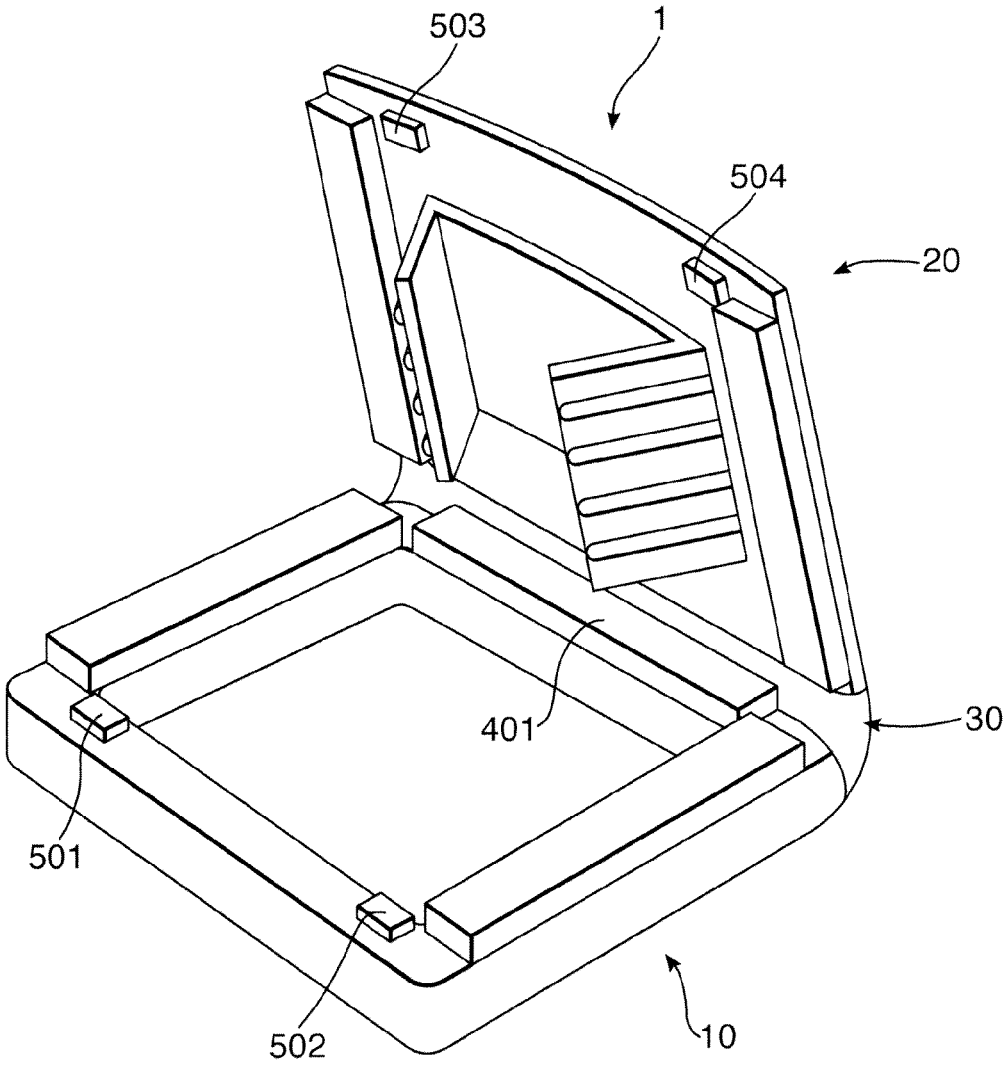
FIG. 32 is a perspective view of another of the preferred embodiments of the device (1) according to the invention.

The device (1) may comprise one or more sealing means. Preferably the device (1) comprises one sealing means (401) when the connection (30) is a hinge. In one aspect of the present invention, the sealing means may be located within the cavity (12), on the side of the cavity (12) adjacent to the connection (30) or on the control zone (16) adjacent to the connection (30) as shown in FIG. 32. The sealing means (401)

is located on the internal surface (201) of the second portion (20) adjacent to the connection (30). In a further aspect the sealing means (401) is part of the connection (30). Without wishing to be bound by theory, it is believed that the sealing means (401) is provided to avoid displacement of the hair treatment composition (15) towards the connection (30) itself and prevent the hair bundle (11) from snagging in said connection (3) when the second portion (20) is brought into a juxtaposed relationship to the first portion (10). When the second portion (20) is pivoted about the connection (30) on the first portion (10), the hair treatment composition (15) may be displaced toward the connection (30). A sealing means (401) adjacent to the connection (30) may avoid displacement. The sealing means (401) acts as a barrier for the hair treatment composition (15) to stay within the cavity (20) where it is available for the hair bundle (11). Useful materials to manufacture a sealing means (401) include but are not limited to those described herein above for said first fin (71). Preferably, the sealing means (401) is manufactured from TPE.

One or more stop mechanisms may be incorporated into the device (1) according to the invention. The stop mechanism collaborates with the connection (30) to ensure that when the second portion (20) is brought into a juxtaposed relationship to the first portion (10), the second portion (20) and the system (70) associated thereto are not unduly forced within the cavity (12) of the first portion (10). The stop mechanism may be manufactured during the same manufacturing step as the first portion (10), the second portion (20) and/or the connection (30). In one aspect of the present invention, the stop mechanism may be one or more tines, teeth of a comb-like structure. In another aspect of the present invention two stop mechanisms (501; 502) are comprised upon the control zone (16) of the first portion (10) and two stop mechanisms (503; 504) are comprised upon the internal surface (201) of the second portion (20).

Useful materials to manufacture said stop mechanism may include those materials to manufacture said first portion (10) as described herein above, among others and combinations thereof.

Method

A further aspect of the present invention is a method for creating hair bundle effects. The method comprises the steps of selecting a hair bundle (11); optionally, marking and separating the selected hair bundle (11) by applying one or more markings tools (300; 300') as described in details below; placing at least a portion of the selected hair bundle (11) between the first portion (10) and the second portion (20) of the device (1) according to invention; and bringing the second portion (20) into a juxtaposed relationship to the first portion (10). The device (1) is then moved along the length of the hair bundle (11). Optionally this process can be repeated a further time, optionally more than one more time to obtain the desired application. Once the application of the hair treatment composition (15) is terminated for a single hair bundle (11), the device (1) may be moved to another hair bundle (11) by bringing the second portion (20) into a remote relationship to the first portion (10). The hair treatment composition (15) may be left in place for a time sufficient to create a hair bundle effect. Thereafter, the hair treatment composition (15) may be removed by rinsing with water and or shampooing the hair.

Kit

Figure 33:
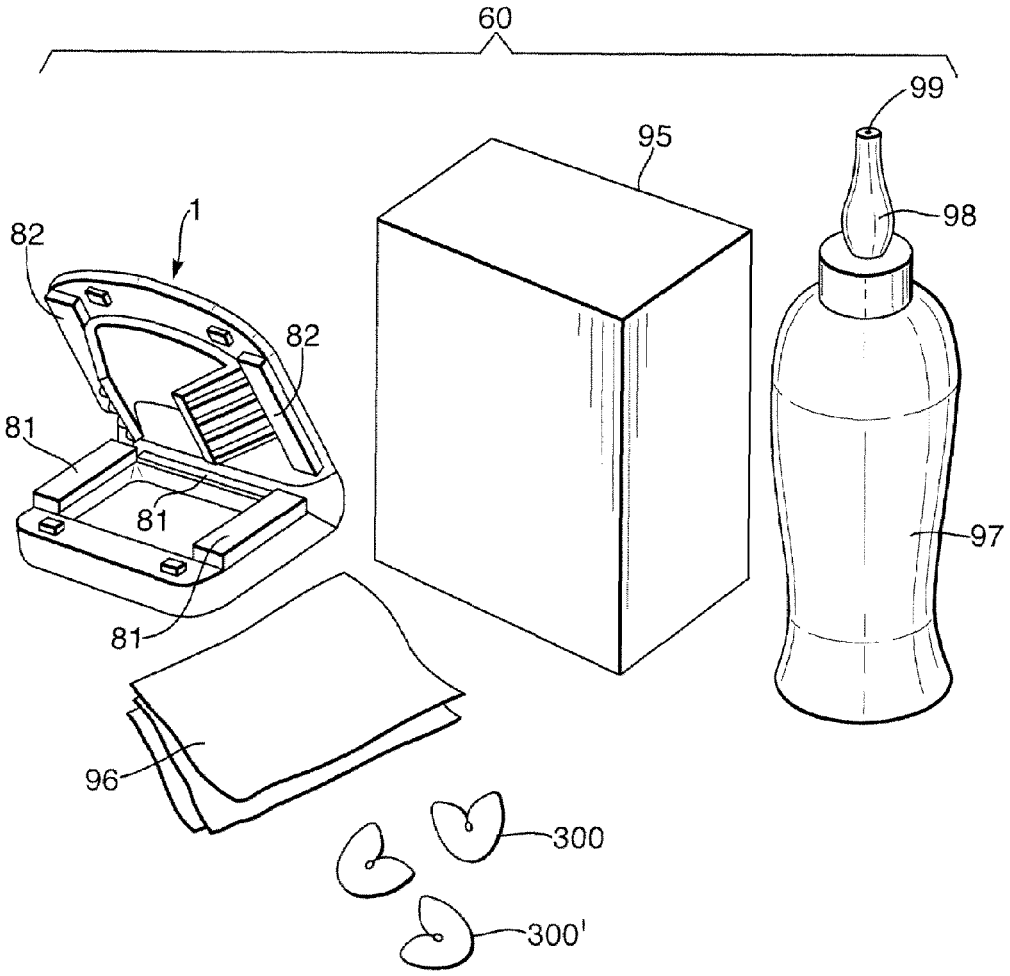
FIG. 33 illustrates an embodiment of a kit (60) comprising the device (1) according to the invention.

For the purpose of sale and/or use, a kit (60) for creating hair bundle effects may be assembled. One embodiment of the kit (60) is shown in FIG. 33, wherein the features of the kit (60) may be assembled within a package (95), in this specific embodiment a box.

Figure 34:
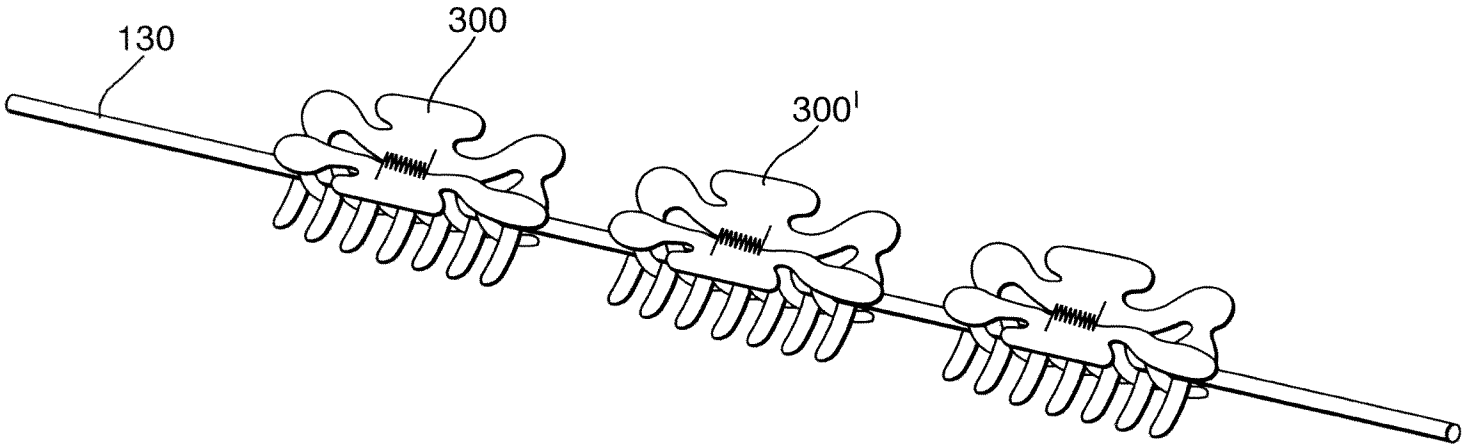
FIG. 34 depicts an embodiment of an implement (130) comprising a plurality of marking tools (300; 300').
Figure 35:
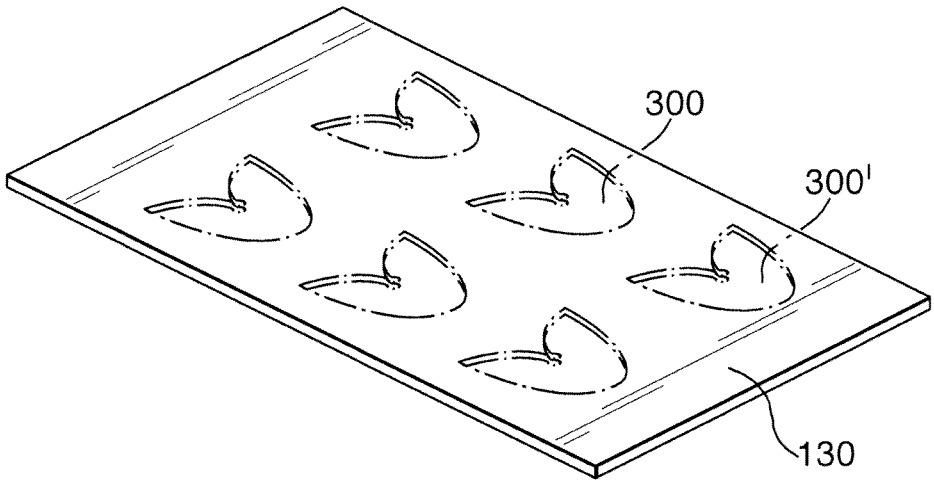
FIG. 35 illustrates another embodiment of an implement (130) comprising a plurality of marking tools (300; 300').

The kit (60) for creating hair bundle effects comprises at least one device (1) according to the invention and a hair treatment composition (15). Preferably, the kit (60) further comprises one or more marking tools (300; 300') for marking and separating a hair bundle (11) from the remaining hair. In another embodiment, the kit (60) further comprises an implement (130), wherein the implement (130) comprises a plurality of marking tools (300; 300') for marking and separating a hair bundle (11) from the remaining hair. Preferably, each marking tool of the plurality of marking tools (300; 300') is independently associated to but removable from the implement (130). Many types of marking tools (300; 300') can be used, including clips, such as those conventionally used for hair care as shown in FIGS. 34 and 35. The implement (130) comprises a plurality of marking tools (300; 300') wherein each tool of the plurality marking tools (300; 300') is independently attached to the implement (130). The marking tools (300; 300') may be chemically and/or mechanically attached to the implement (130). The marking tools (300; 300') may be chemically attached by means of adhesives, for example a hot melt adhesive. The marking tools (300; 300') may be mechanically attached by interlocking. Preferably the marking tools (300; 300') of the plurality of marking tools (300; 300') attached to the implement (130) are substantially flat. In one aspect, the implement (130) is a sheet of material and the marking tools (300; 300') are attached to the surface of the sheet of material by means of an adhesive. The sheet of material may include, but it is not limited to, one page of the instructions (96) as described herein after. The marking tools (300; 300') may be a common clip for use in hair care as shown in FIG. 34 and the implement (130) is a stick whereupon the clips are engaged. In another aspect illustrated in FIG. 35, the implement (130) is a cardboard sheet and the plurality of marking tools (300; 300') are punctured through the cardboard sheet. Each marking tool (300; 300') is then excised from the cardboard sheet when needed. The cardboard sheet may include, but it is not limited to, the package (95) of a kit (60) as described above.

The kit (60) may further comprise instructions (96). The instructions (96) may comprise information and directions in how to use the device (1) and how to prepare and apply the hair treatment composition (15). The instructions (96) may further include one or more illustrations of at least one type of a hair bundle effect and an indication where to select on the head the hair bundles (11) to be treated in order to obtain a similar hair bundle effect.

The hair treatment composition (15) comprised within the kit (60) according to the invention may be packaged in a sachet and/or in a bottle (97), for dispensing of the hair treatment composition (15) into the device (1).

The hair treatment composition (15) according to the invention is selected from the group consisting of highlighting compositions, dyeing compositions, perming compositions, styling compositions and combinations thereof. Preferably, the hair treatment composition (15) is selected from the group consisting of highlighting compositions, dyeing compositions and combinations thereof, more preferably the hair treatment composition (15) is a highlighting composition.

The hair treatment compositions (15) may further comprise components known, conventionally used, or otherwise effective for use in hair treatment compositions particularly oxidative bleaching and dye compositions which include but are not limited to: developer dye compounds; coupler dye compounds; direct dyes, D&C Orange 4, Acid Yellow 1, D&C Red No. 28, Disperse Red 17, HC Blue No. 15, Acid Blue; oxidizing agents; reducing agents; thickeners; chelants; pH modifiers and buffering agents; alkalising agents, carbonate ion sources and radical scavenger systems; glycine; amodimethicone, ethylenediamine disuccinic acid; anionic, cationic, non-ionic, amphoteric or zwitterionic surfactants, or mixtures thereof, anionic, cationic, non-ionic, amphoteric or zwitterionic polymers, hydrophobically modified polymers or mixtures thereof; fragrances; dispersing agents; solvents, peroxide stabilizing agents; chelants, humectants, proteins and derivatives thereof, plant materials (e.g. aloe, chamomile and henna extracts); silicones (volatile or non-volatile, modified or non-modified), film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) and are useful in identifying specific adjuvants to achieve a particular purpose or multipurpose. A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

In one aspect of the present invention, the hair treatment composition (15) is prepared by mixing a first individually packaged component and a second individually packaged component. When mixed, the first and second individually packaged components form the hair treatment composition (15) to be applied to the selected hair bundle (11). Examples of such compositions include so called semi-permanent and permanent colorants which typically contain oxidative dyes and an oxidant, and highlighting compositions containing an oxidant and an alkalising agent, optionally with a persulfate salt. In one embodiment of the kit (60) according to the present invention the hair treatment composition (15) is a highlighting composition prepared by mixing a first individually packaged component with a second individually packaged component. The first individually packaged component preferably comprises from about 3% to about 12% of hydrogen peroxide by weight of said first individually packaged component. The second individually packaged component is preferably in the form of a powder, granules or paste and comprises from about 10% to about 60% of persulfate salt selected from the group consisting of sodium persulfate, potassium persulfate, ammonium persulfate and mixtures thereof, by weight of said second individually packaged component. The kit (60) optionally comprises a third individually packaged component comprising from about 3% to about 25% of an alkalizing agent in an aqueous vehicle, by weight of said third individually packaged component.

In another embodiment of the present invention, the hair treatment composition (15) is prepared by mixing a first individually packaged component comprising from about 1.5% to about 12% of hydrogen peroxide by weight of said first individually packaged component and a second individually packaged component comprising from about 0.01% to about 6% of a dye selected from the group consisting of direct dyes, oxidative dye precursors, oxidative dye couplers and mixtures thereof, by weight of said second individually packaged component.

Figure 36:
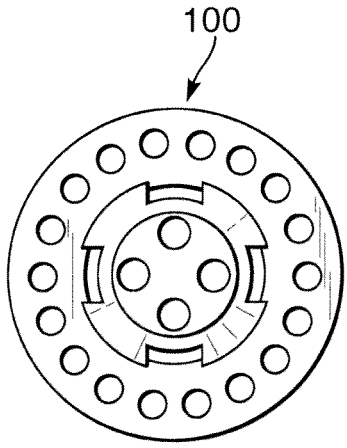
FIG. 36 shows a top view of the mesh (100) comprised in the kit (60) of the present invention.

As shown in FIG. 32, preferably the bottle (97) of kit (60) comprises a nozzle (98) having an opening (99), wherein the bottle (97) further comprises a mesh (100) for holding back clumps of not dissolved hair treatment composition (15) larger than the opening (99). More preferably, the mesh (100) comprised within the kit (60) is as shown in FIG. 36. Without wishing to be bound by theory, it is believed that decomposition of hydrogen peroxide may occur when highlighting or colouring composition are created by mixing individually packaged components as described above. Evolution of gas may occur within a relative short time. In the event that a clump of not dispersed persulfate salt clogs the opening (99) of the nozzle (98), the pressure created by the gas within the bottle (97) may cause the clump to be ejected from the opening (99). A mesh (100) as shown in FIG. 36 is advantageous as it prevents the clump arriving at the opening (99).

Device (1)
Cap (2)
Hook (3)
Hole (4)
First portion (10)
Hair bundle (11)
Cavity (12)
Perimeter (13)
Outer edge (14)
Hair treatment composition (15)
Control zone (16)
First slot (21)
Second slot (22)
Second portion (20)
Connection (30)
Kit (60)
System (70)
First fin (71)
Second fin (72)
Additional fins (73; 74)
Connecting element (75)
Joining member (76)
First metering layer (81)
Second metering layer (82)
First supporting means (91)
Second supporting means (92)
Package (95)
Instruction (96)
Bottle (97)
Nozzle (98)
Opening (99)
Mesh (100)
First holding knob (101)
Second holding knob (102)
Embossments (107-114)
Implement (130)
Internal surface (201)
External surface (202)
Contour (203)
Marking tools (300; 300')
Sealing means (401)
Stop mechanisms (501-504)
Fitting means (600)
Tines (700; 700')
First free distal edge (712)
First trailing edge (713)
First internal face (714)
First external face (715)
First leading edge (716)
First upper edge (717)
Second free distal edge (722)
Second trailing edge (723)
Second internal face (724)
Second external face (725)
Second leading edge (726)
Second upper edge (727)
Plane (P)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments or the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for creating hair bundle effects to a hair bundle, the device comprising a. a first portion and b. a second portion;

wherein the first portion comprises a cavity for comprising a hair treatment composition and the cavity is delimited by a perimeter; wherein the first portion further comprises an outer edge; wherein a control zone extends between the perimeter of the cavity to the outer edge; and wherein a first metering layer extends upon at least a portion of the control zone of the first portion; wherein the first metering layer is a material selected from the group consisting of non-woven materials, foam and combinations thereof;

wherein a system for bending the hair bundle within the cavity of the first portion is associated with the second portion;

wherein the system comprises at least a first fin and a second fin; wherein each fin has a free distal edge; wherein the free distal edge of the first fin points towards the free distal edge of the second fin;

wherein the first portion is movably joined to the second portion by a connection, thereby the second portion is brought from a remote relationship to a juxtaposed relationship to the first portion; and wherein in that juxtaposed relationship at least a portion of the first fin, a portion of the second fin, or a portion of the first fin and the second fin projects within the cavity of the first portion.

2. The device according to claim 1, wherein a second metering layer extends upon at least a portion of the second portion; wherein the second metering layer is a material selected from the group consisting of non-woven, foam and combinations thereof.

3. The device according to claim 2, wherein the second metering layer extends upon at least a portion of the internal surface of the plate.

4. The device according to claim 1, wherein the second portion is a plate comprising an internal surface, an external surface and a contour; wherein the plate is selected from the group consisting of a substantially flat plate, a convex plate, a concave plate and combinations thereof.

5. The device according to claim 4, wherein the system is associated with the internal surface of the plate.

6. The device according to claim 5, wherein the first fin and the second fin of the system have a parallelepiped form; wherein the first fin comprises a first upper edge and the second fin comprises a second upper edge; wherein the system further comprises a connecting element; wherein the connecting element connects the first upper edge to the second upper edge and wherein the connecting element itself is associated with the internal surface of the plate.

7. The device according to claim 4, wherein a first slot and a second slot are arranged through the plate; wherein the first fin is engaged within the first slot and wherein the second fin is engaged within the second slot.

8. The device according to claim 7, wherein part of the first fin and part of the second fin protrude behind the external surface outside the first slot and the second slot and wherein the system further comprises a joining member which connects the protruding part of the first fin to the protruding part of the second fin beyond the external surface.

9. The device according to claim 1, wherein the first metering layer extends upon at least two portions of the control zone.

10. The device according to claim 1, wherein the first fin, the second fin, or the first fin and the second fin comprises one or more modifications selected from the group consisting of embossments, imprints and combinations thereof.

11. A kit for creating hair bundle effects comprising at least one device according to claim 1 and a hair treatment composition, wherein the hair treatment composition is selected from the group consisting of highlighting compositions, dyeing compositions, styling compositions, perming compositions and combinations thereof.

12. The kit according to claim 11 wherein the kit further comprises one or more marking tools for marking and separating a hair bundle from the remaining hair.

13. The kit according to claim 11, wherein the kit further comprises an implement; wherein the implement comprises a plurality of marking tools for marking and separating a hair bundle from the remaining hair; wherein each tool of the plurality of tools is independently associated to but removable from the implement and wherein each of the tools is substantially flat.

14. A device for creating hair bundle effects to a hair bundle, the device comprising a. a first portion and b. a second portion;

wherein the first portion comprises a cavity for comprising a hair treatment composition;

wherein a metering layer extends upon at least a portion of the second portion and the metering layer is a material selected from the group consisting of non-woven materials, foam and combinations thereof;

wherein a system for bending the hair bundle within the cavity of the first portion is associated with the second portion;

wherein the system comprises at least a first fin and a second fin, wherein each fin has a free distal edge and wherein the free distal edge of the first fin points towards the free distal edge of the second fin; and wherein the first portion is movably joined to the second portion by a connection, thereby the second portion is brought from a remote relationship to a juxtaposed relationship to the first portion; and wherein in that juxtaposed relationship at least a portion of the first fin, a portion of the second fin, or a portion of the first fin and the second fin projects within the cavity of the first portion.

15. The device according to claim 14, wherein the second portion is a plate comprising an internal surface, an external surface and a contour; wherein the plate is selected from the group consisting of a substantially flat plate, a convex plate, a concave plate and combinations thereof.

16. The device according to claim 14, wherein the first fin and the second fin of the system have a parallelepiped form; wherein the first fin comprises a first upper edge and the second fin comprises a second upper edge; wherein the system further comprises a connecting element; wherein the connecting element connects the first upper edge to the second upper edge and wherein the connecting element itself is associated with the internal surface of the plate.

17. The device according to claim 16, wherein a first slot and a second slot are arranged through the plate; wherein the first fin is engaged within the first slot and wherein the second fin is engaged within the second slot.

18. The device according to claim 17, wherein part of the first fin and part of the second fin protrude behind the external surface outside the first slot and the second slot and wherein the system further comprises a joining member which connects the protruding part of the first fin to the protruding part of the second fin beyond the external surface.

19. The device according to claim 14, wherein the first fin, the second fin, or the first fin and the second fin comprises one or more modifications selected from the group consisting of embossments, imprints and combinations thereof.

20. A kit for creating hair bundle effects comprising at least one device according to claim 14 and a hair treatment composition, wherein the hair treatment composition is selected from the group consisting of highlighting compositions, dyeing compositions, styling compositions, perming compositions and combinations thereof.

* * * * *